US012565724B2

(12) United States Patent
Mazzoni et al.

(10) Patent No.: US 12,565,724 B2
(45) Date of Patent: Mar. 3, 2026

(54) CALENDER AND METHOD FOR TREATING WEB-LIKE MATERIALS

(71) Applicant: FUTURA S.P.A., Capannori (IT)

(72) Inventors: Gionata Mazzoni, Capannori (IT); Piero Bontempo, Capannori (IT)

(73) Assignee: FUTURA S.P.A., Capannori (IT)

( * ) Notice: Subject to any disclaimer, the term of this patent is extended or adjusted under 35 U.S.C. 154(b) by 416 days.

(21) Appl. No.: 18/281,613

(22) PCT Filed: Feb. 8, 2022

(86) PCT No.: PCT/IT2022/050021
§ 371 (c)(1),
(2) Date: Sep. 12, 2023

(87) PCT Pub. No.: WO2022/190146
PCT Pub. Date: Sep. 15, 2022

(65) Prior Publication Data

US 2024/0158975 A1 May 16, 2024

(30) Foreign Application Priority Data

Mar. 12, 2021 (IT) ..... 102021000005897

(51) Int. Cl.
*D06C 23/04* (2006.01)
*D06C 15/02* (2006.01)
(Continued)

(52) U.S. Cl.
CPC ..... *D06C 23/04* (2013.01); *D06C 15/02* (2013.01); *D21G 1/0026* (2013.01); *D21G 1/0093* (2013.01); *D21G 1/0253* (2013.01)

(58) Field of Classification Search
CPC ..... D21G 1/0026; D21G 1/0093
(Continued)

(56) References Cited

U.S. PATENT DOCUMENTS 4,498,383 A 2/1985 Pav et al.
5,819,149 A * 10/1998 Watanabe ..... G03G 15/657 399/68
(Continued)

FOREIGN PATENT DOCUMENTS

CN 110891887 A 3/2020
CN 112154112 A 9/2022
(Continued)

*Primary Examiner* — Jacob T Minskey
(74) *Attorney, Agent, or Firm* — Rivka Friedman

(57) ABSTRACT

Calender for treating web materials, comprising a structure for supporting two heated rollers forming a nip, wherein each roller has surface reliefs (RR) and in an operational setting of the calender the reliefs of one roller are radially opposed to those of the other roller, each roller rotates with a predetermined angular speed around its axis, the rollers are heated by heating means, and each roller undergoes an axial elongation as a consequence of its heating. The calender comprises detection means (E1, E2; IS) adapted to detect the axial elongation of each roller and a programmable control unit (UCP) connected to the detection means and to the heating means. The control unit is programmed to determine the difference between the axial elongations of the rollers and emitting an alarm signal if the absolute value of this difference is greater than a limit value.

14 Claims, 20 Drawing Sheets

(51) Int. Cl.
*D21G 1/00* (2006.01)
*D21G 1/02* (2006.01)

(58) Field of Classification Search
USPC ..... 162/206
See application file for complete search history.

(56) References Cited

U.S. PATENT DOCUMENTS

| | | | | |
|---|---|---|---|---|
| 2005/0053388 | A1* | 3/2005 | Yokoyama | G03G 15/1625 399/302 |
| 2006/0236878 | A1 | 10/2006 | Natsume et al. | |
| 2007/0166071 | A1* | 7/2007 | Shima | G03G 15/161 399/303 |
| 2010/0101202 | A1* | 4/2010 | Okumura | D01F 6/62 526/321 |
| 2013/0108415 | A1* | 5/2013 | Hashimoto | F01D 17/162 415/150 |

FOREIGN PATENT DOCUMENTS

| | | | |
|---|---|---|---|
| DE | 3131799 | A1 | 4/1983 |
| EP | 2662206 | A2 | 11/2013 |
| FI | 20125497 | L | 5/2012 |
| JP | 2870023 | B2 | 3/1999 |
| JP | 2006297786 | A | 11/2006 |
| WO | 2020183504 | A1 | 9/2020 |

* cited by examiner

CALENDER AND METHOD FOR TREATING WEB-LIKE MATERIALS

The present invention relates to a calender and a method for treating web-like materials.

More particularly, a calender and a method according to the present invention relate to the treatment of web-like materials by means of heated rollers.

The treatment of web-like materials, in particular non-woven fabric (TNT), is described in U.S. Pat. No. 3,507,943 which illustrates a system comprising a calender formed by two heated embossing rollers which define a nip crossed by a web of material of the TNT type containing fibers thermoplastics. The material that crosses the nip between the two rollers is subjected to combined pressure and heat which determines a change in the arrangement and physical state of the fibers contained in the material itself. In particular, depending on the pressure exerted by the rollers on the material subjected to treatment, on the operating temperature of the rollers, on the thickness and composition of the material, as well as on the surface processing of the rollers, deformations corresponding to predetermined patterns can be formed on the material. Other systems comprising a calender which uses heated rolls for the treatment of TNT are described in U.S. Pat. No. 4,005,169 and WO2020/183504.

The calender rollers, between which the material subjected to treatment passes, can be arranged in a so-called "tip-to-tip" configuration, which is a configuration in which the reliefs, or "tips", of a calender roller must always be in correspondence with the reliefs of the other calender roller, i.e. the two rollers must always be in phase.

A drawback of calenders thus configured lies in that, in use, the rolls tend to lose their axial phase, which implies the production of products that do not comply with production specifications and, therefore, economic losses.

The main object of the present invention is to provide a system capable of eliminating, or at least drastically reducing, the aforementioned drawbacks. This result has been achieved, in accordance with the present invention, by adopting the idea of making a calender and implementing an operating method having the characteristics indicated in the independent claims. Other characteristics of the present invention are the subject of the dependent claims.

Thanks to the present invention, it is possible to eliminate, or at least contain within predetermined limits, the loss of axial phase of the engraved rollers of a calender for the hot treatment of web-like materials, with evident economic benefits related to the reduction of the production of out-of-specification material. Furthermore, a control mechanism integrated in a calender according to the present invention is a relatively simple mechanism, both from a constructive and functional point of view, and can be easily mounted on already existing calenders.

These and further advantages and characteristics of the present invention will be more and better evident to every person skilled in the art thanks to the following description and the attached drawings, provided by way of example but not to be considered in a limiting sense, in which.

Figure 8:
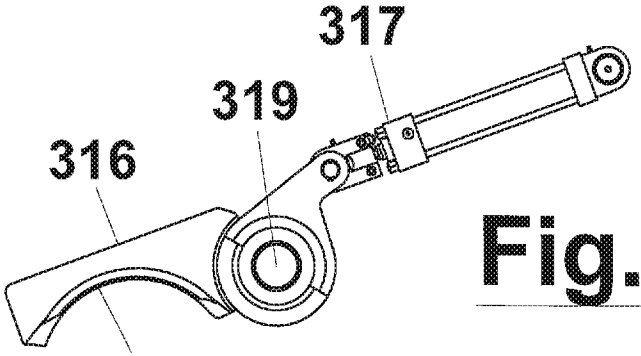
Figure 9:
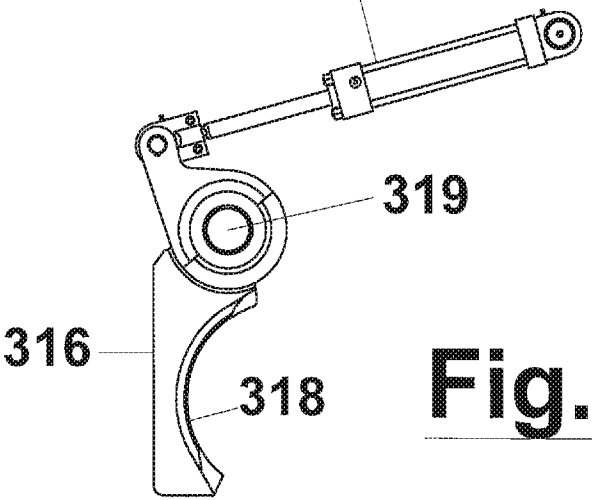
Figure 6:
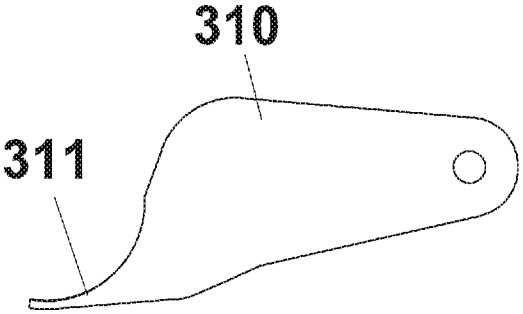
Figure 7:
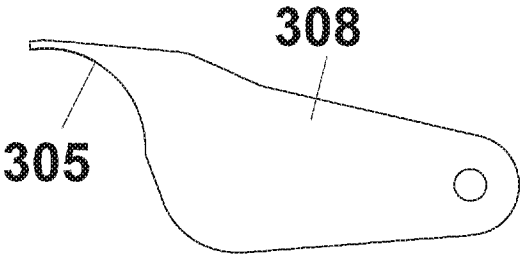
Figure 11:
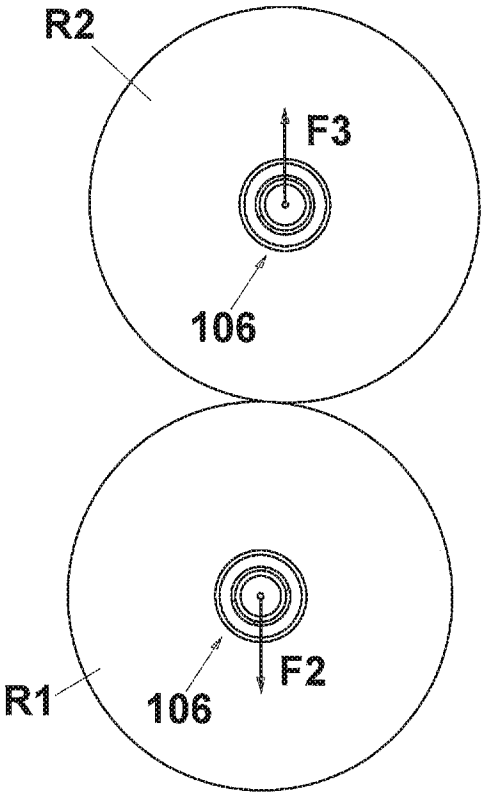
Figure 10:
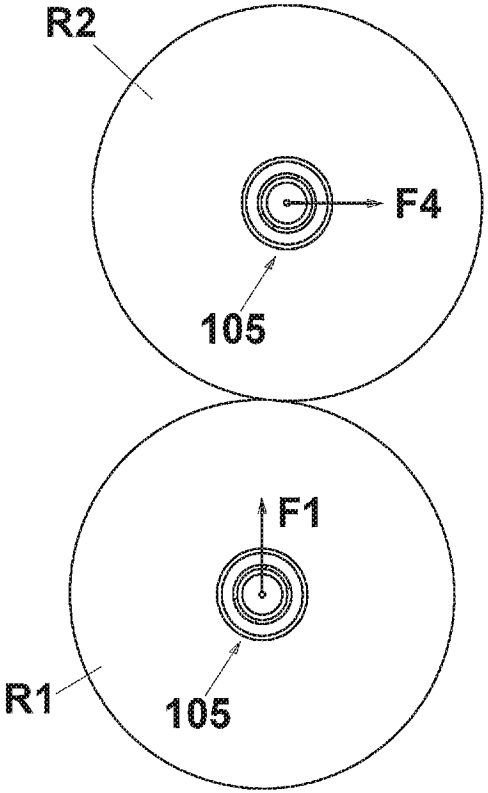
Figure 12:
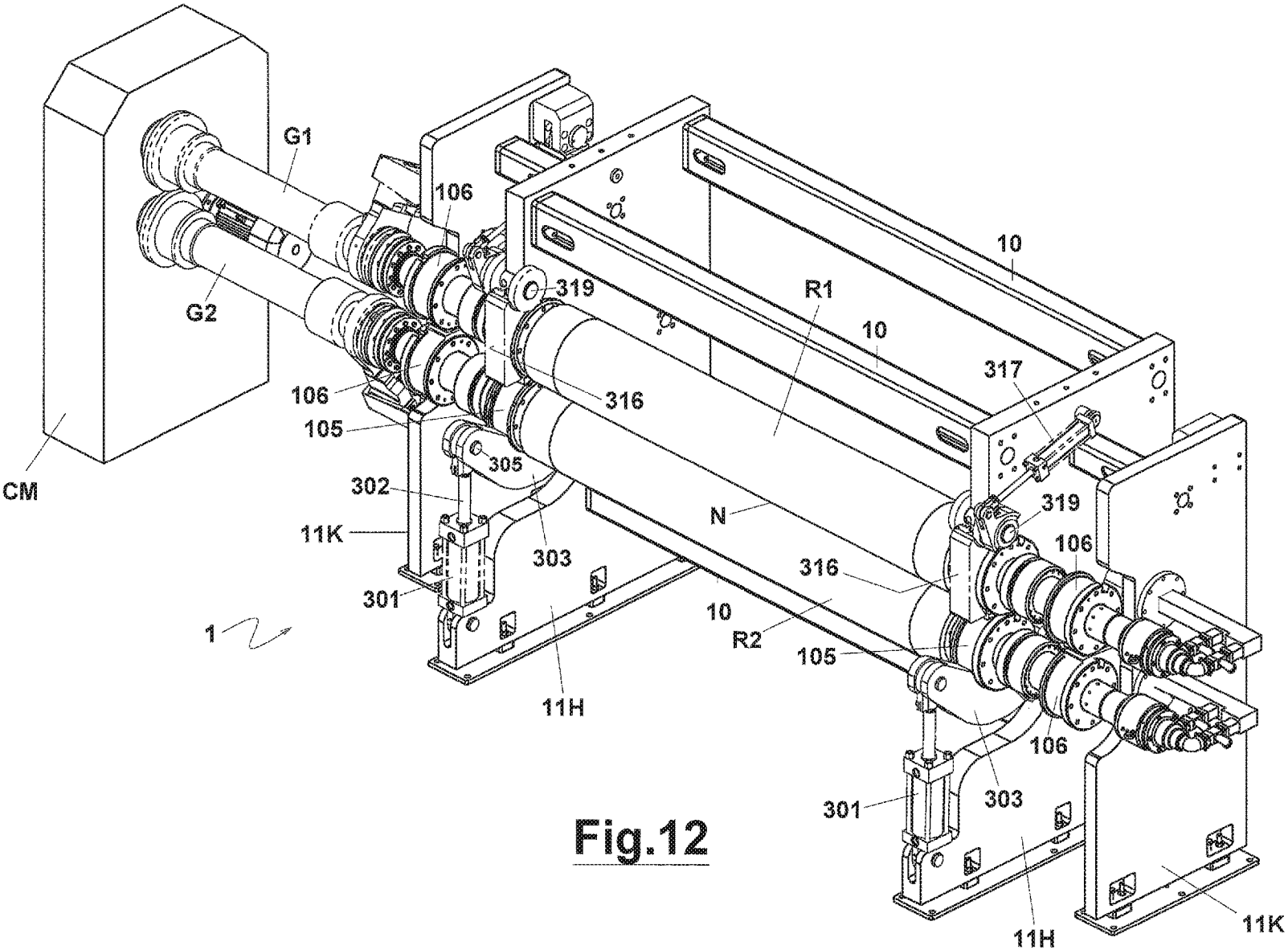
Figure 13:
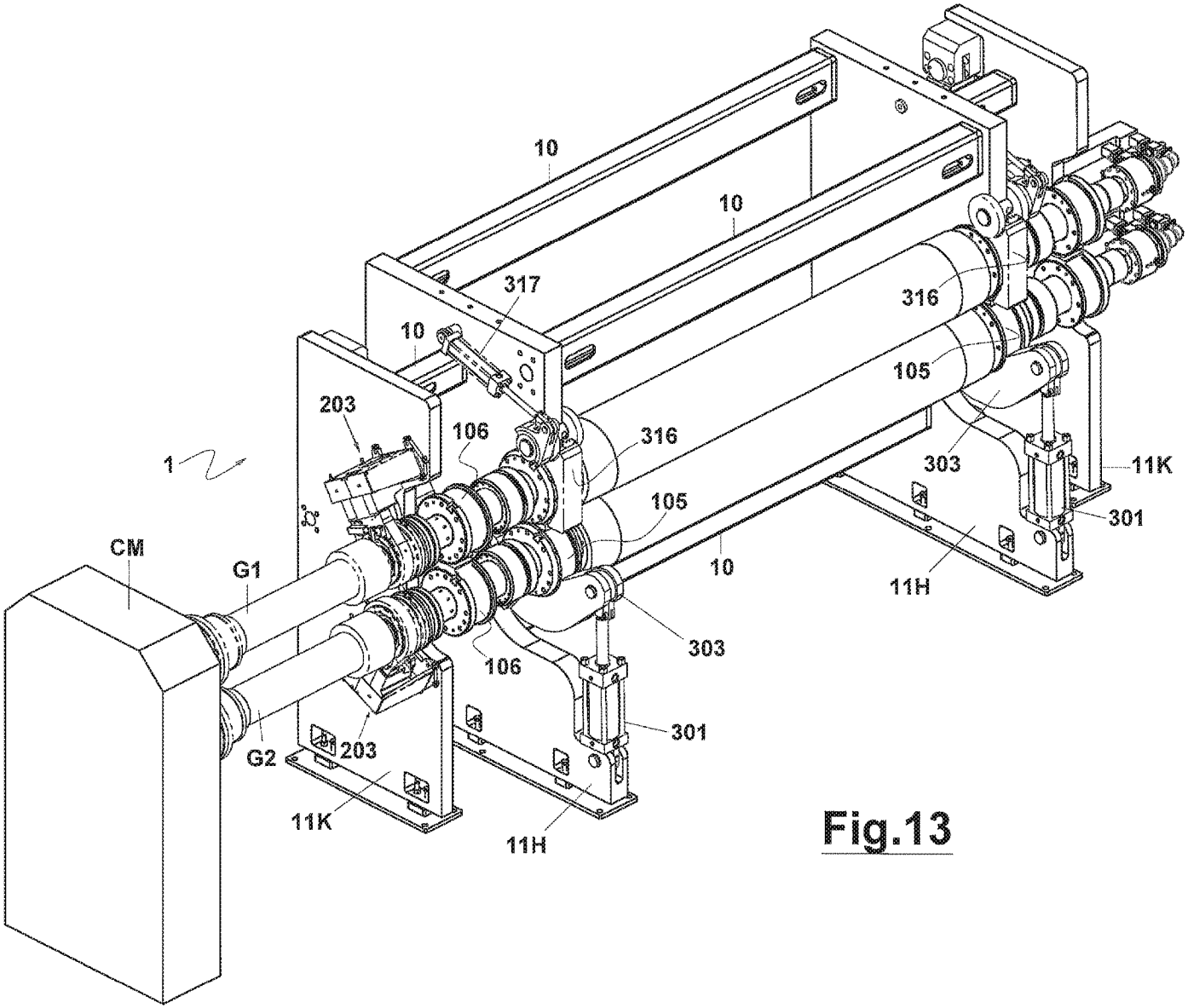
Figure 14A:
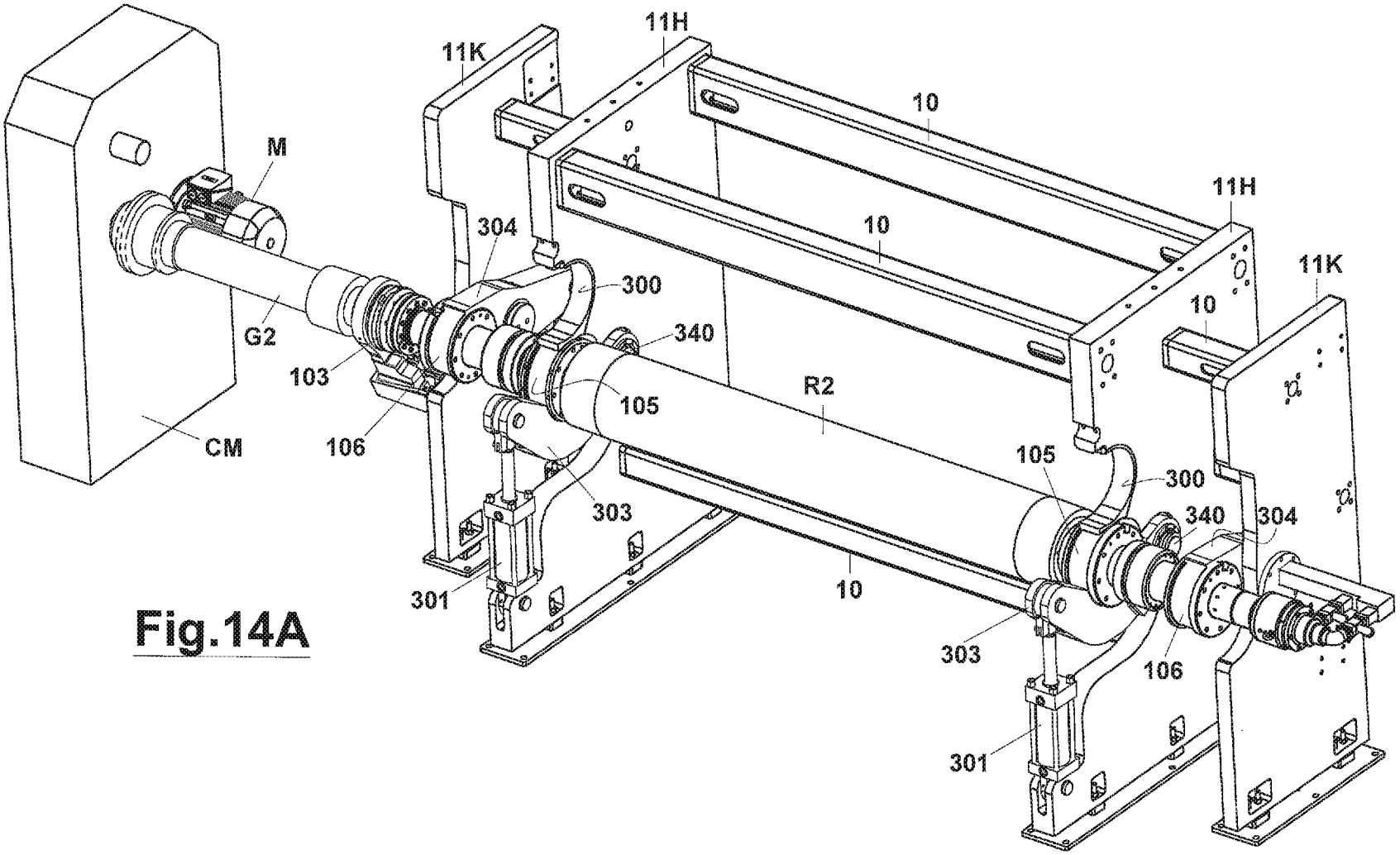
Figure 14B:
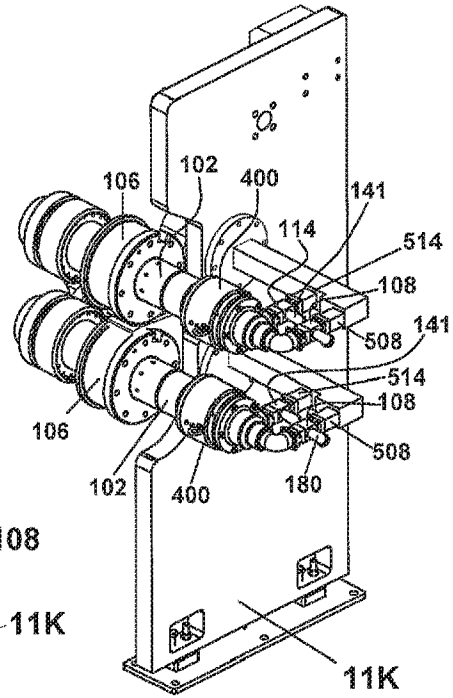
Figure 15:
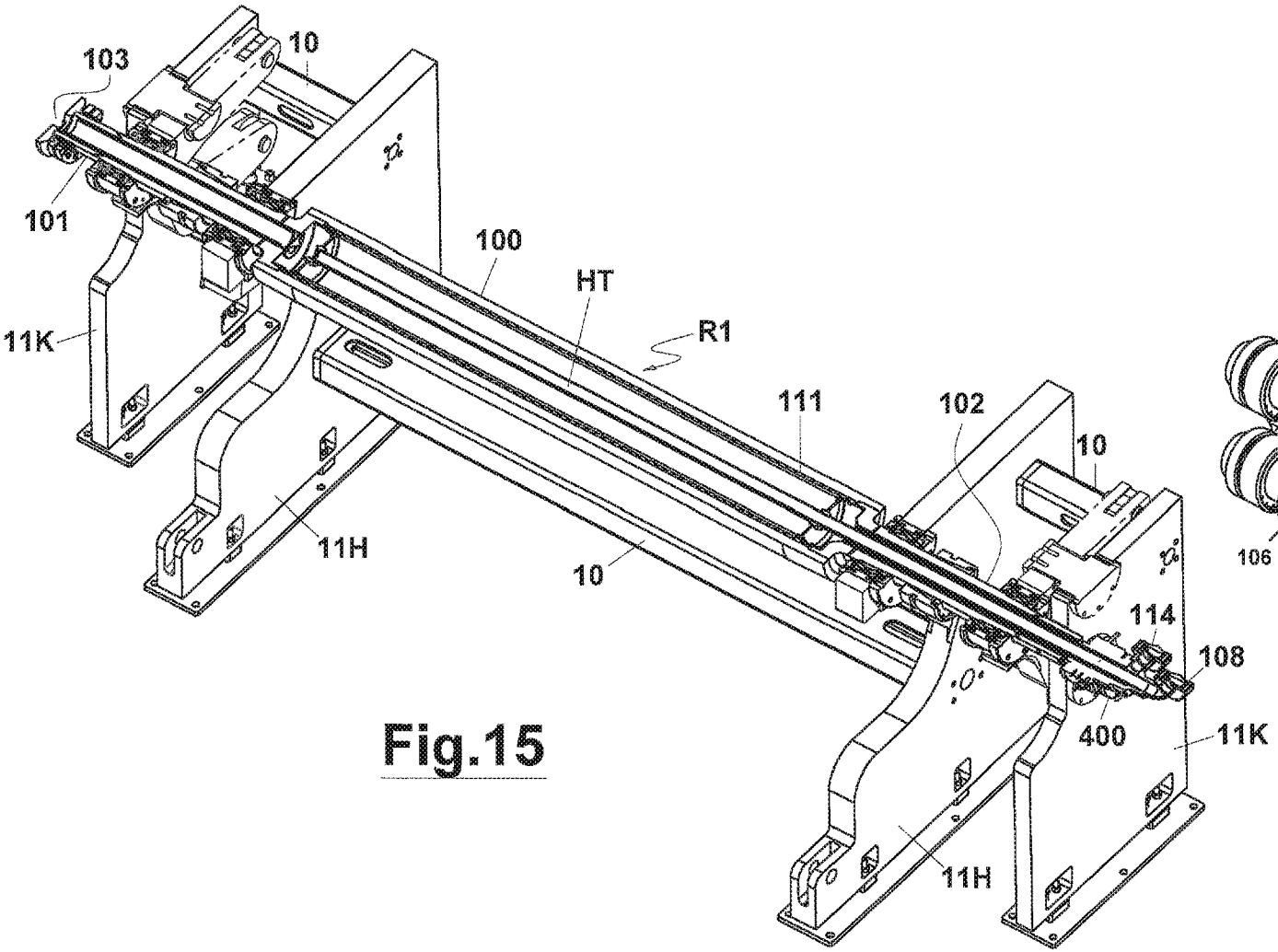
Figure 16C:
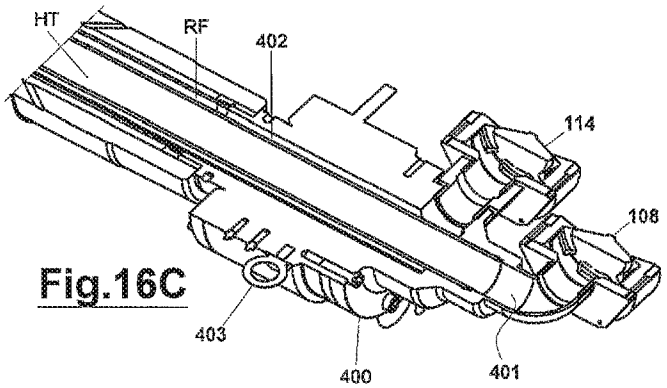
Figure 16B:
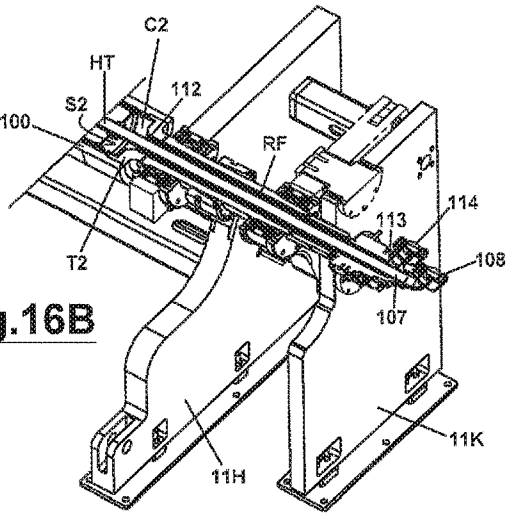
Figure 16A:
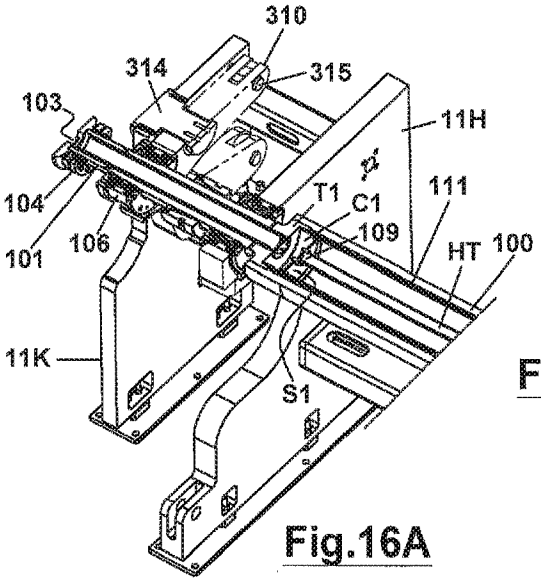
Figure 17:
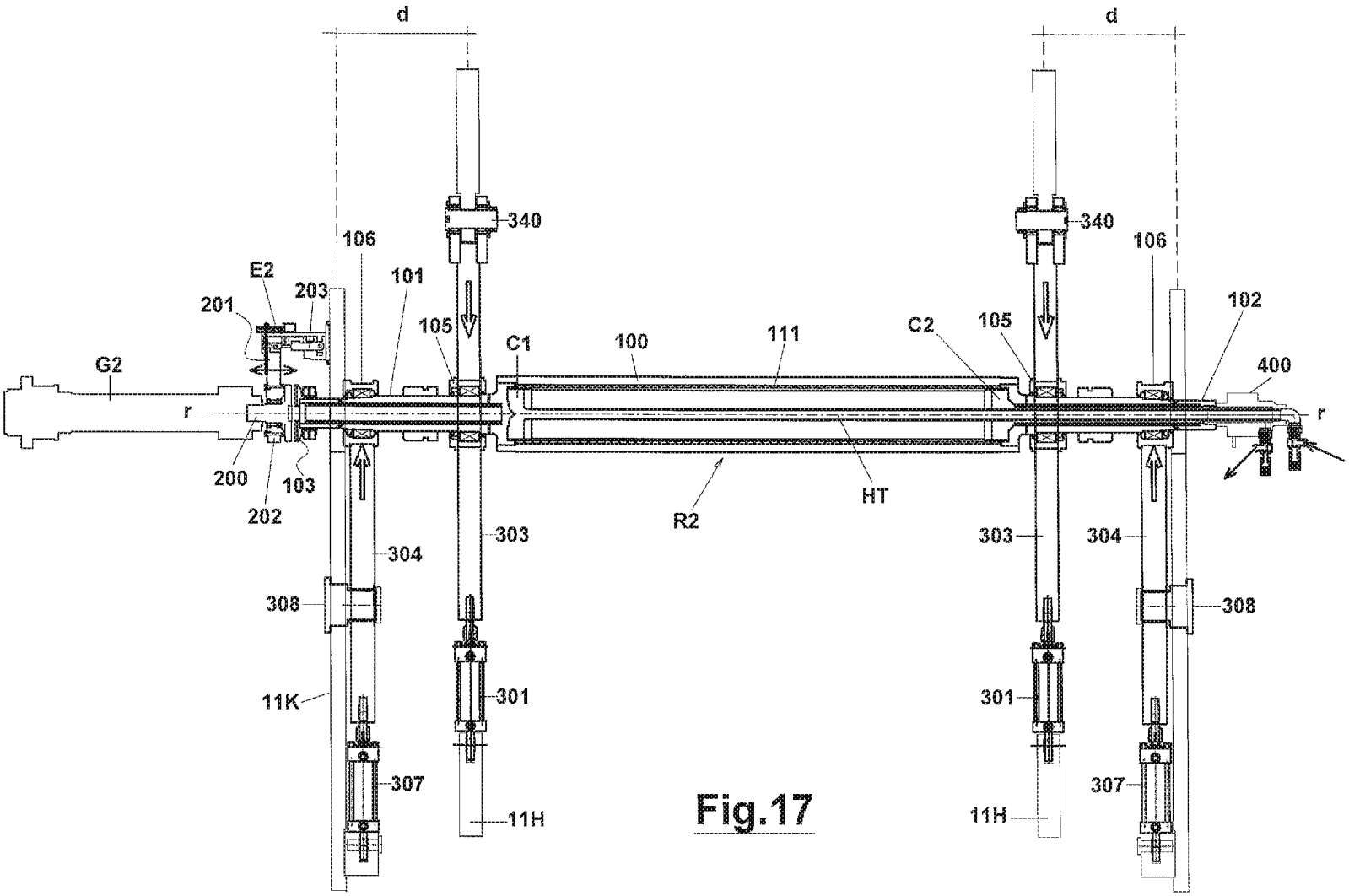
Figure 18A:
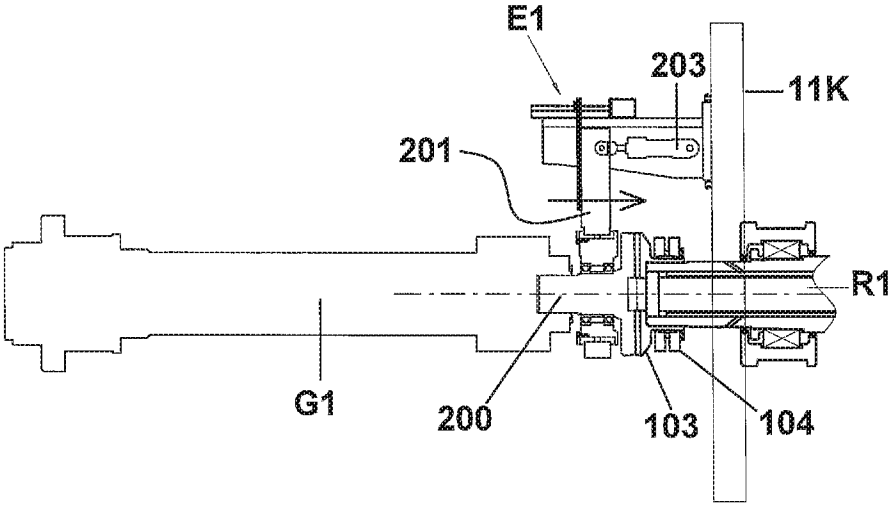
Figure 18B:
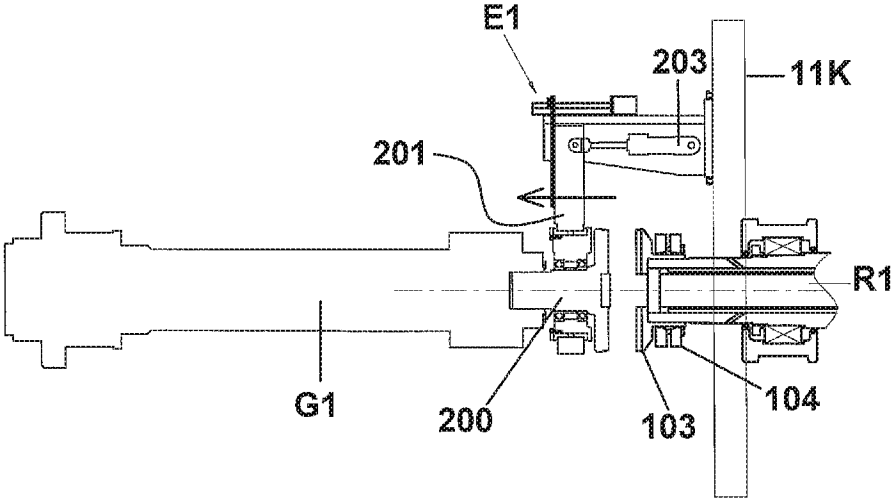
Figure 18C:
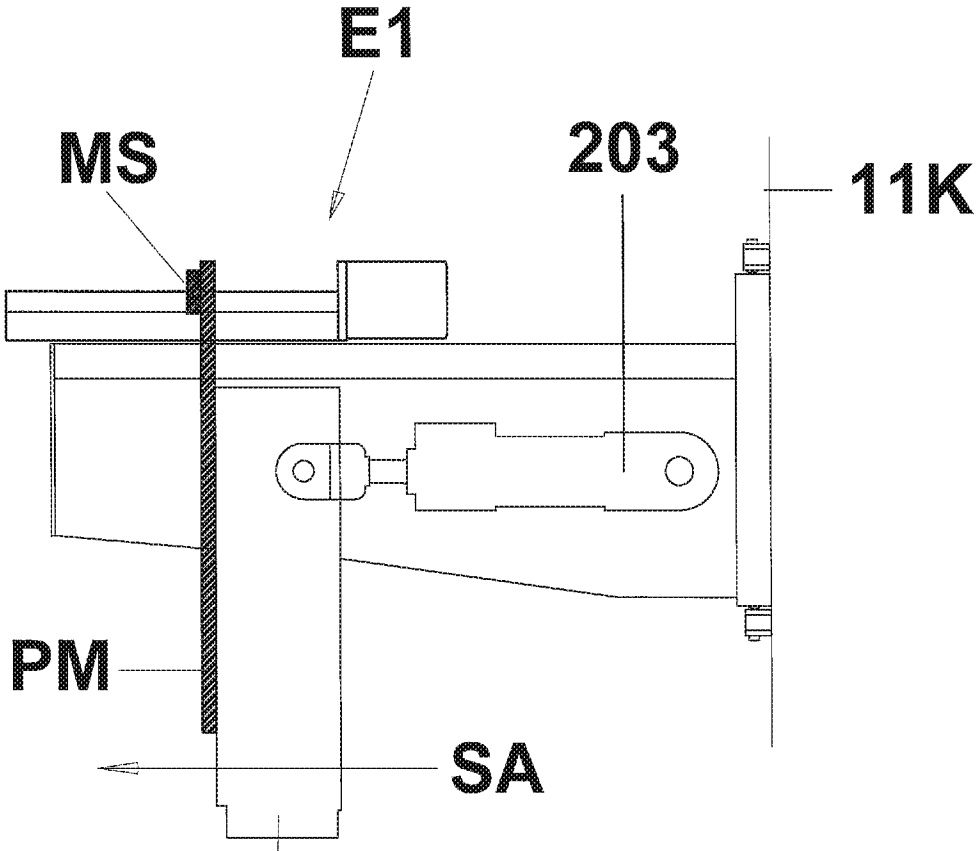
Figure 19B:
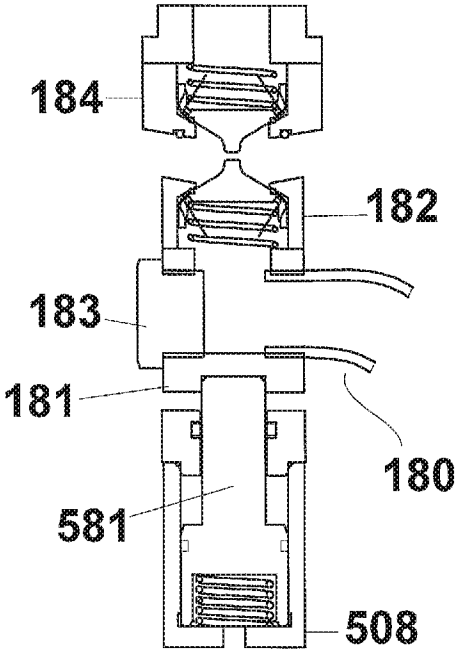
Figure 19A:
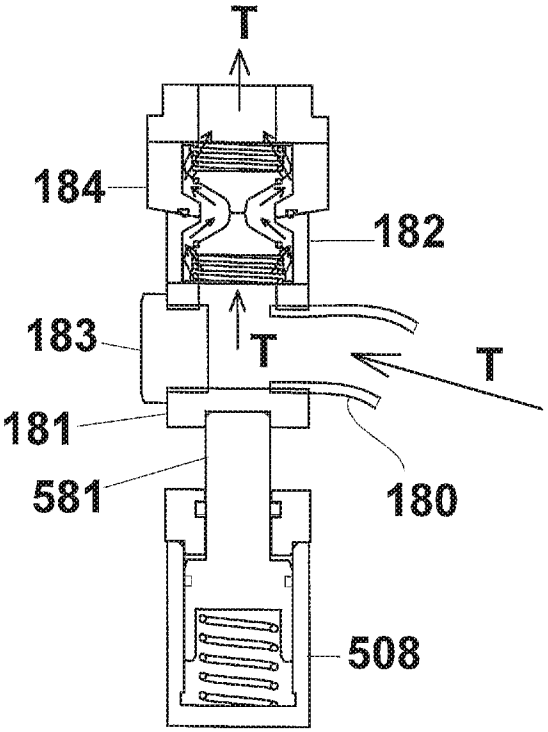
Figures 19C, 19D:
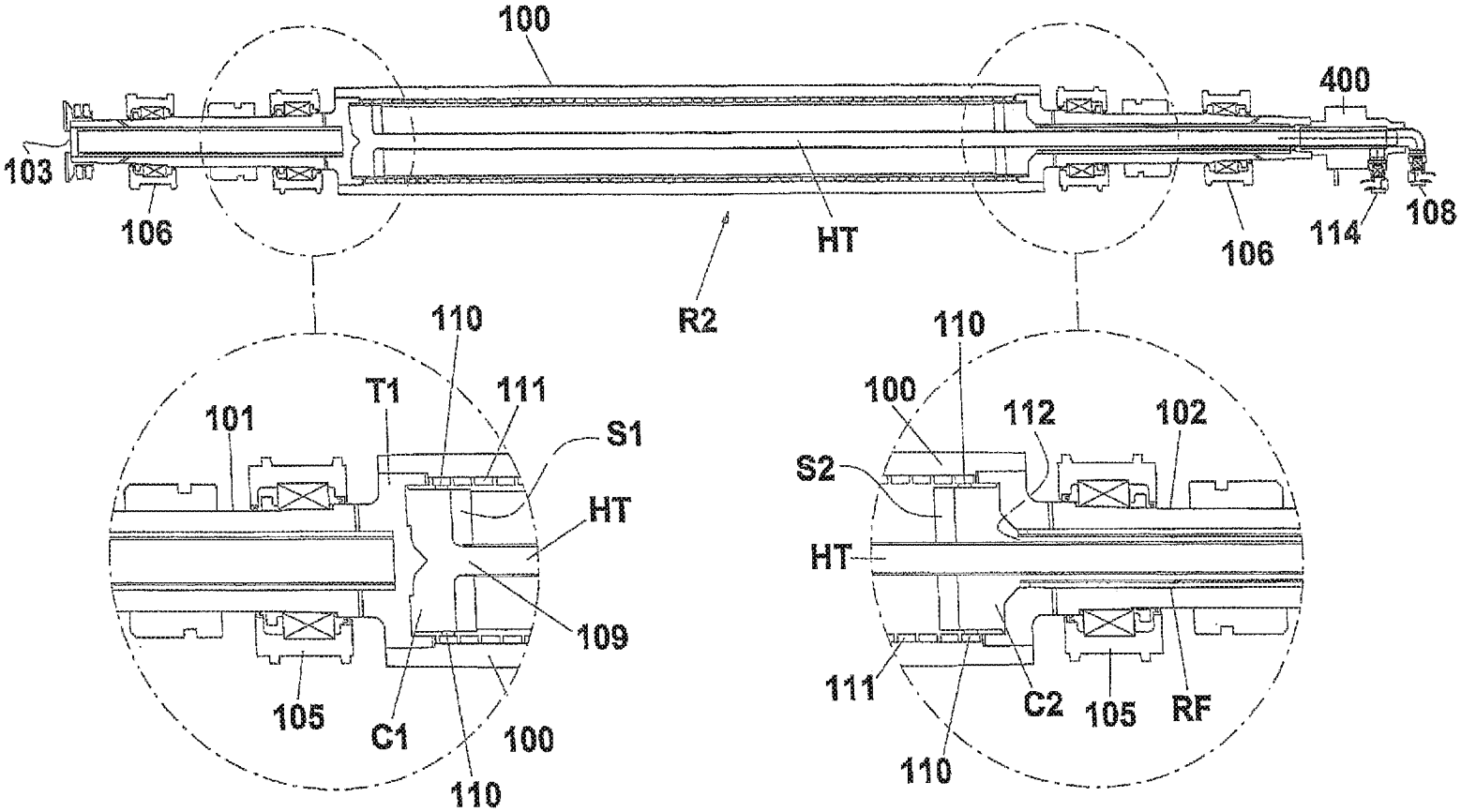
Figure 20A:
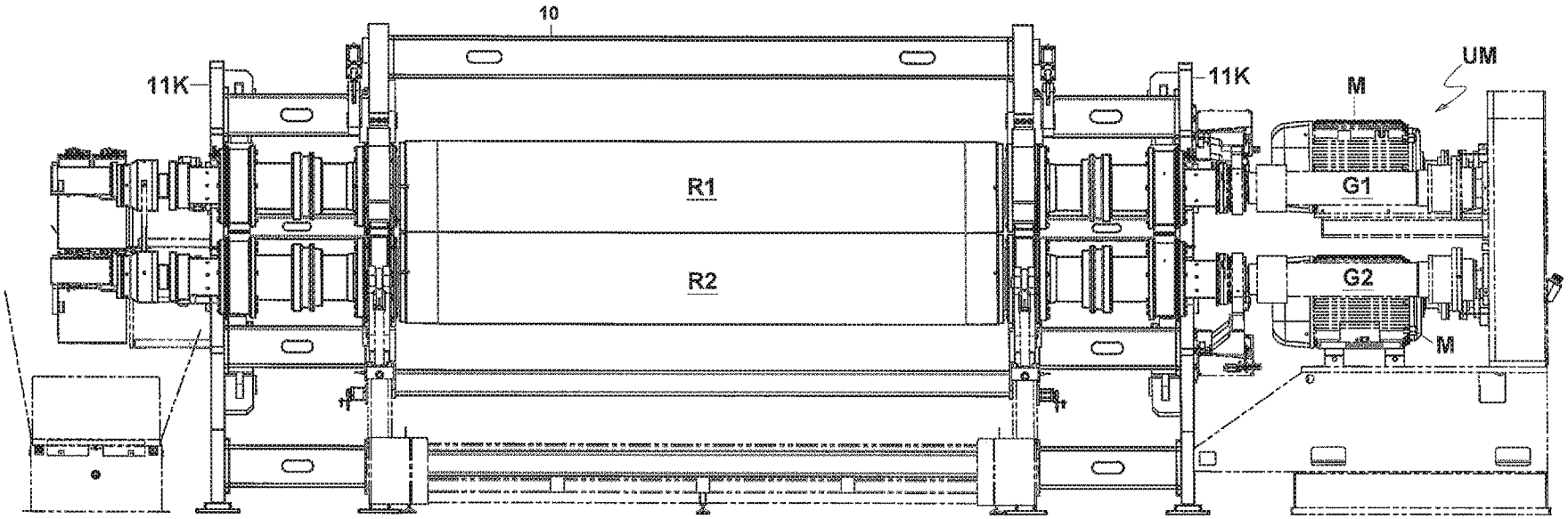
Figure 20B:
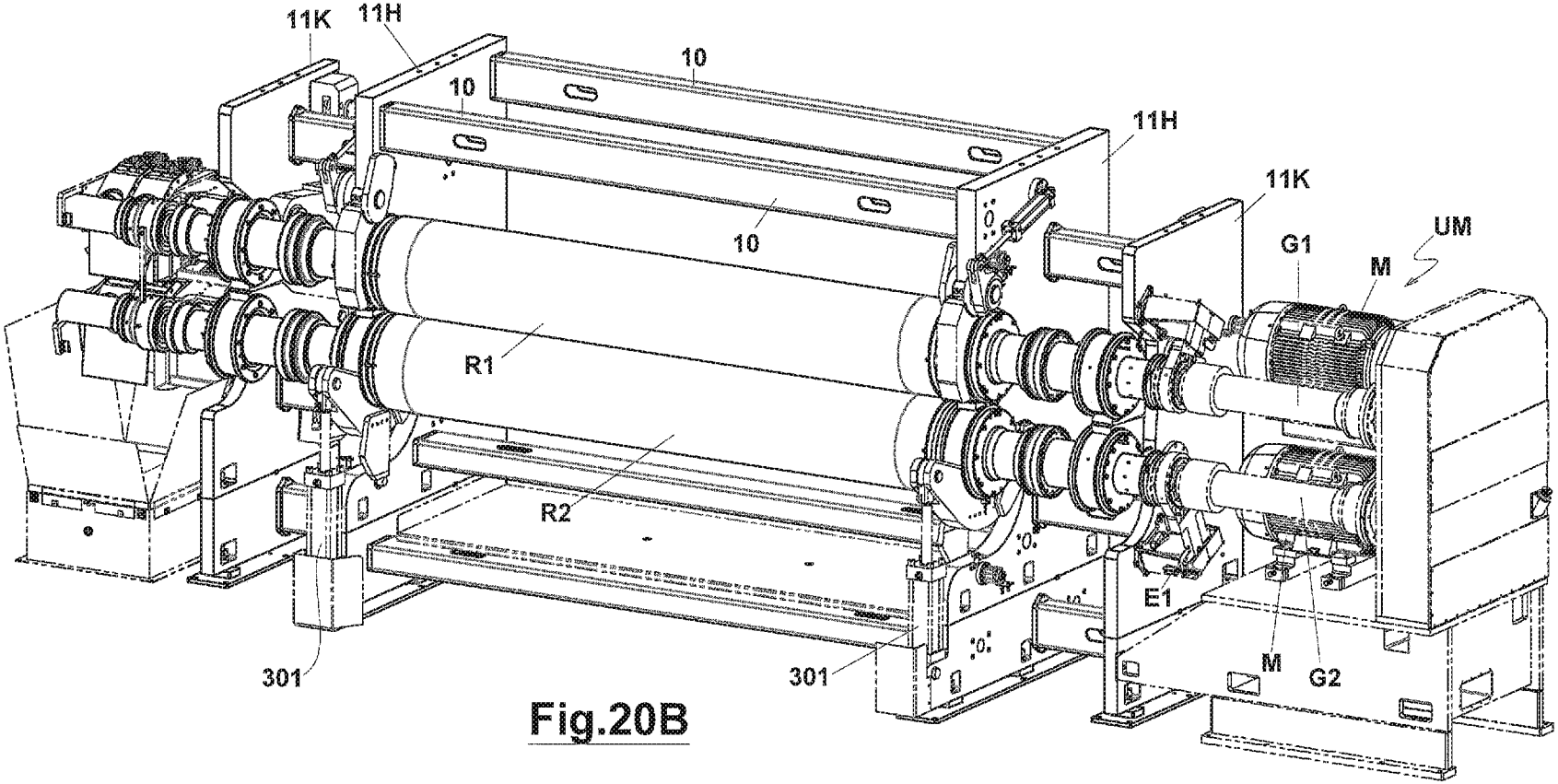
Figure 21:
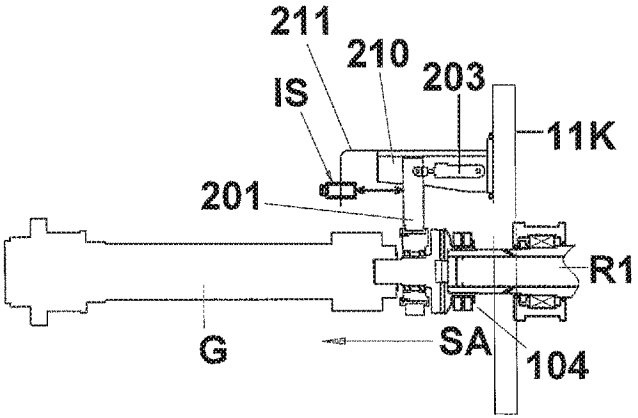
Figure 20C:
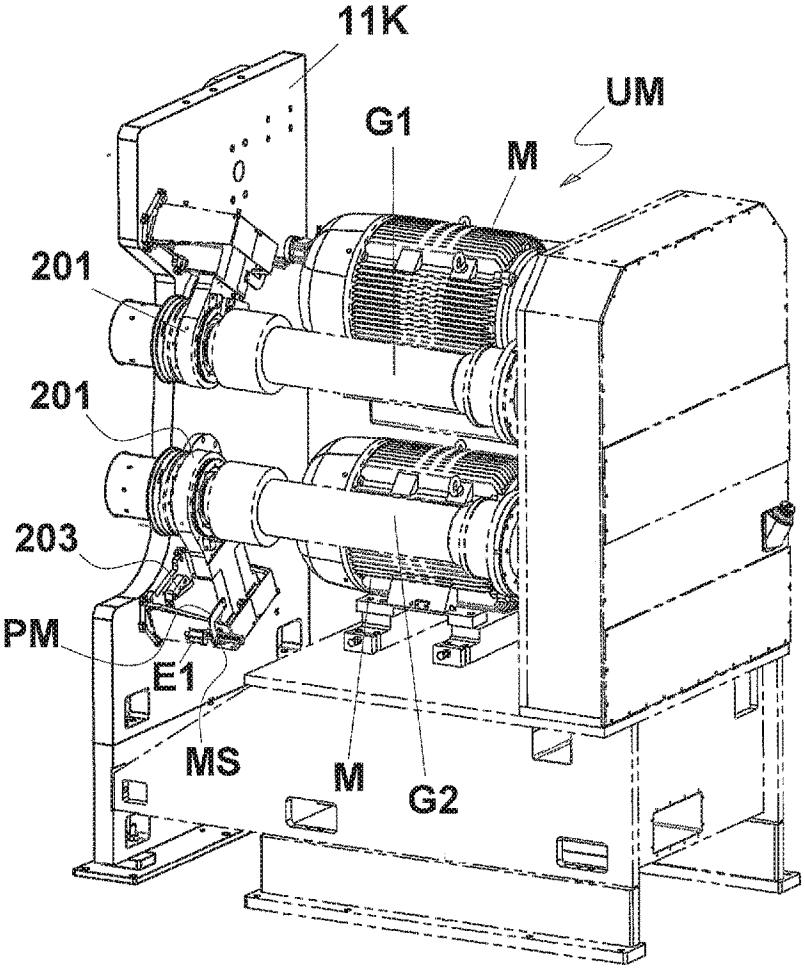
Figure 23:
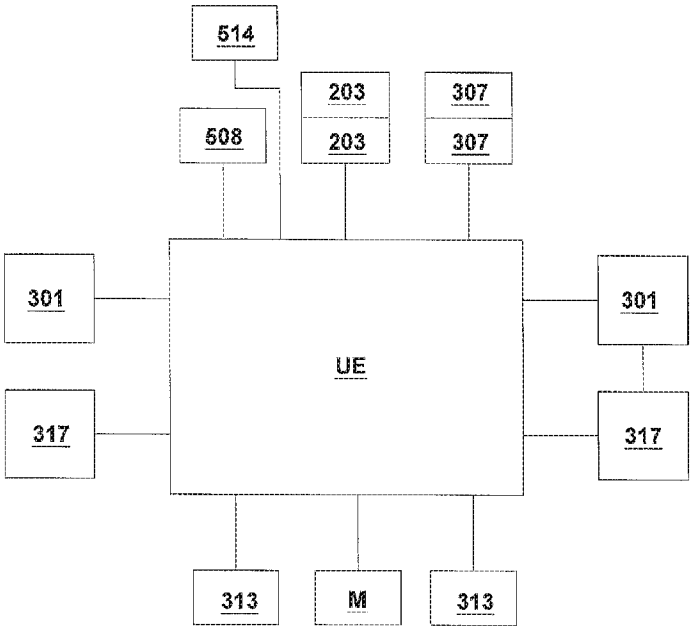
Figure 22:
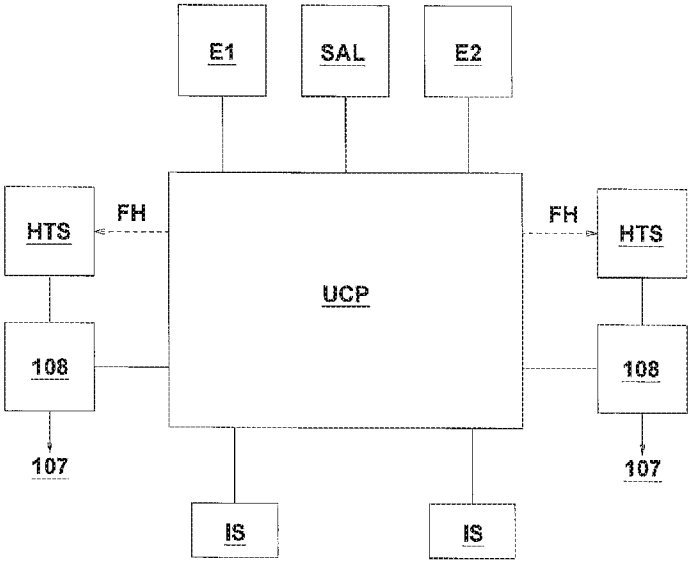
Figure 24:
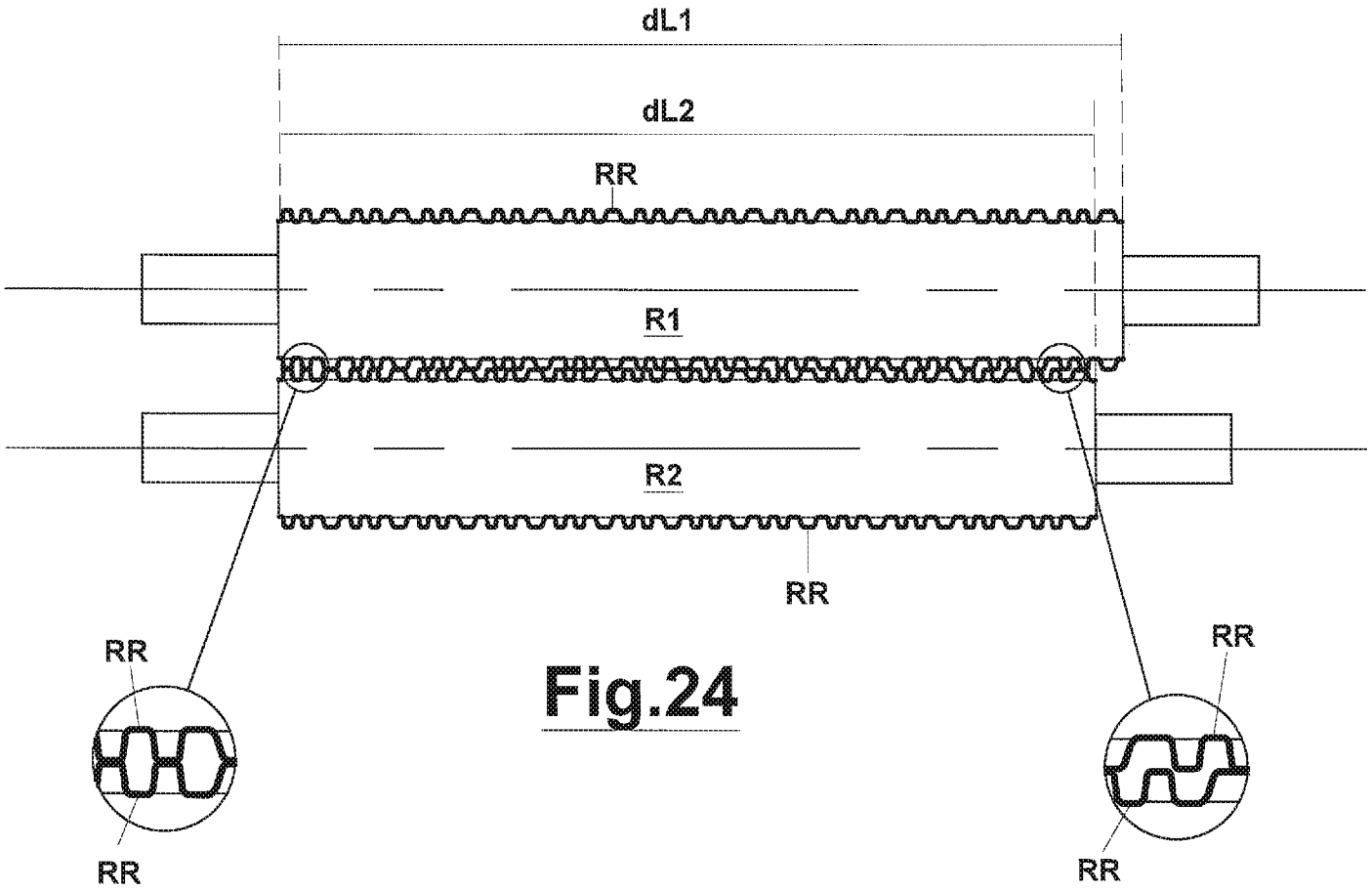

FIGS. 6 and 7 schematically show the levers (308) and (310) in operating position;

FIGS. 8 and 9 schematically show the lever (316) in the operating position (FIG. 9) and in the position of freeing a roller (FIG. 8);

FIGS. 10 and 11 are two diagrams which represent forces acting on the rollers of the calender illustrated in the previous figures;

FIGS. 12 and 13 are two perspective views of a calender according to the present invention;

FIG. 14A represents the calender of FIG. 11 in which some parts are omitted to better highlight others;

FIG. 14B is a detail of FIG. 12;

FIG. 15 represents a schematic horizontal sectional view of the group of FIG. 14A to highlight the internal structure of a calender roll;

FIGS. 16A-16C are enlarged details of FIG. 15;

FIG. 17 represents a schematic horizontal sectional view of the calender illustrated in the previous figures;

FIGS. 18A and 18B are two details that illustrate a joint (G1) in engagement position on the pin of a roller (FIG. 18A) and respectively in disengagement position (FIG. 18B), in which an encoder (E1) arranged for detecting the axle elongation of a roll (R1) of the calender;

FIG. 18C is a detail of FIG. 18A;

FIGS. 19A and 19B are two diagrams that illustrate the opening and closing of a valve (108) for the introduction of the heating fluid into a roller of the calender shown in the previous figures;

FIGS. 19C and 19D are two sectional views at two ends of a calender roll;

FIGS. 20A and 20B are two views of a calender according to a further embodiment of the present invention, in which each roller is driven by a respective motor;

FIG. 20C is a detail of FIG. 20B;

FIG. 21 schematically represents a further modality of implementation of the present invention;

FIG. 22 is a simplified block diagram relating to a possible method of controlling the heating of the rolls in a calender according to the present invention;

FIG. 23 is a simplified block diagram relating to a possible control mode of the actuators in a calender according to the present invention;

FIG. 24 schematically represents a condition of axial displacement of two rollers.

Figure 2:
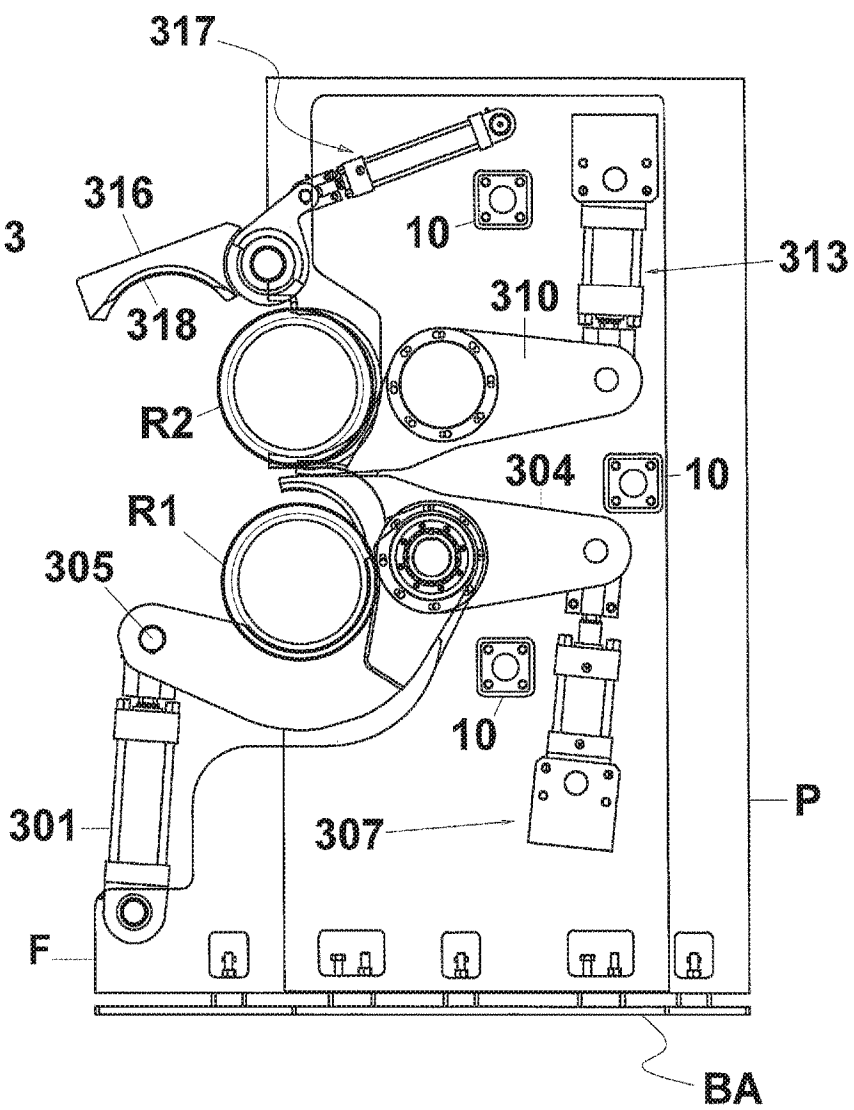
FIG. 2 represents a schematic side view in transparency of a calender according to the present invention in the position of release of the rollers (R1, R2)
Figure 1:
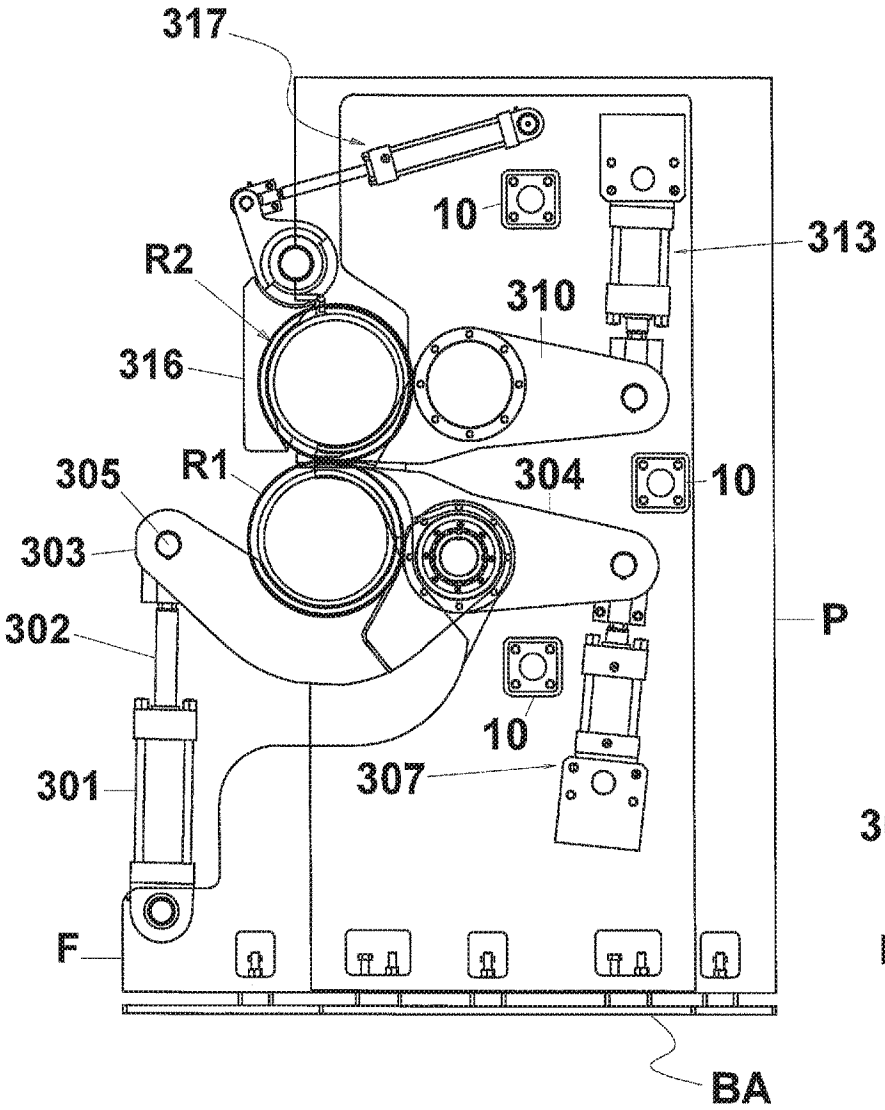
FIG. 1 represents a schematic side view in transparency of a calender according to the present invention in operating position.
Figure 3:
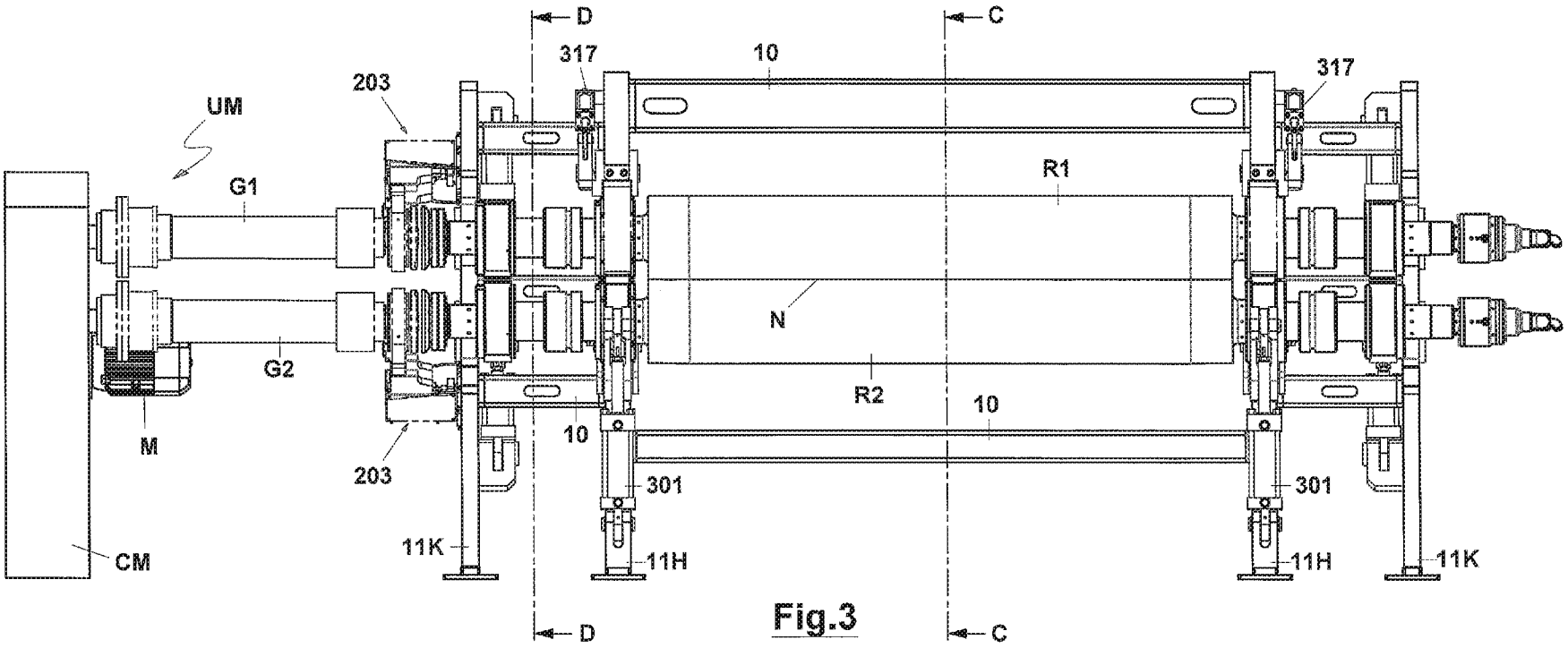
FIG. 3 represents a schematic front view of a calender according to the present invention.
Figure 5:
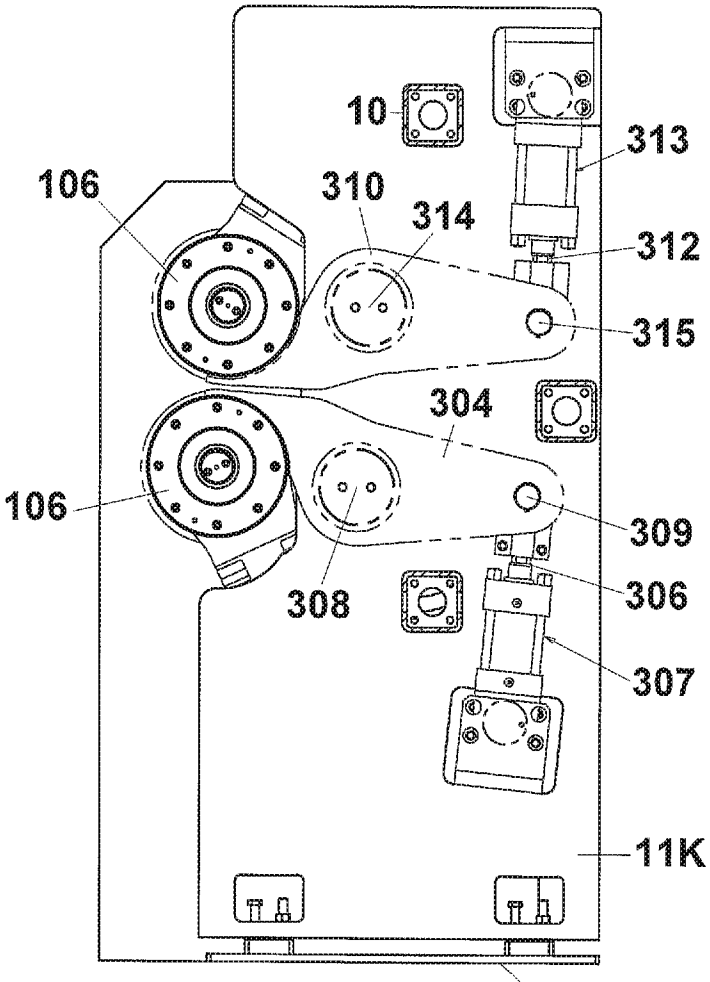
FIG. 5 represents a sectional view along the line D-D of FIG. 3.
Figure 4:
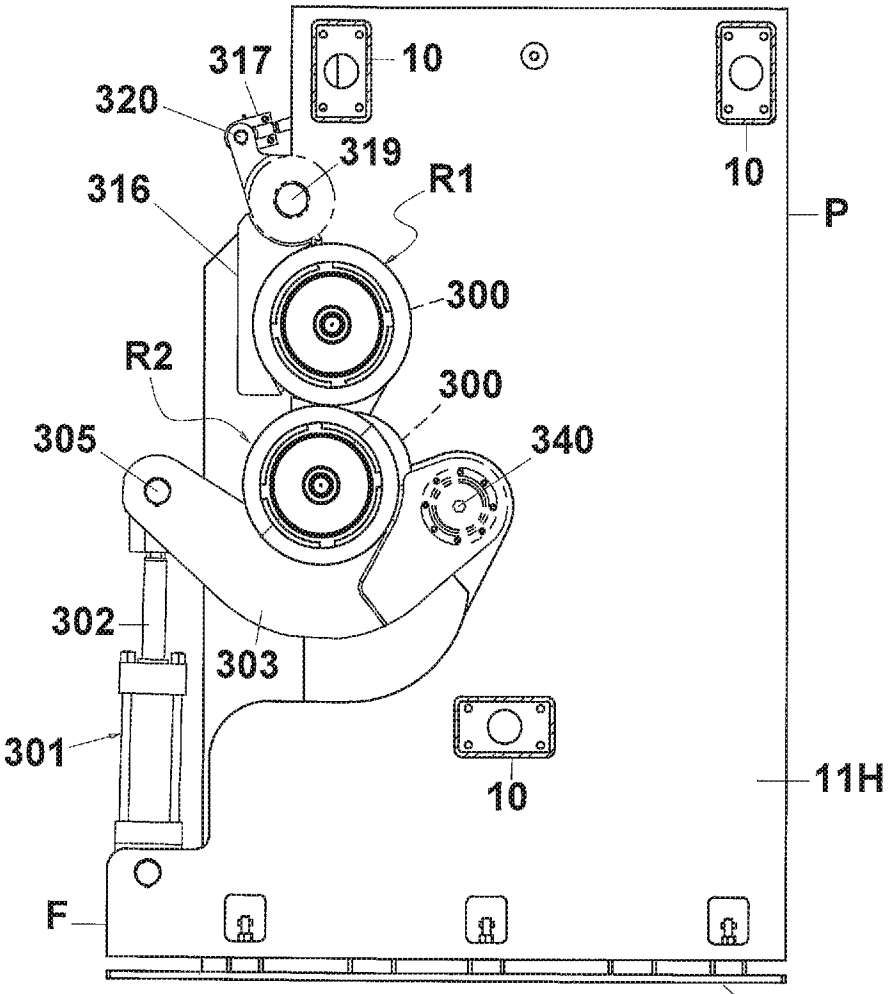
FIG. 4 represents a sectional view along the line C-C of FIG. 3.

A calender (1) according to the present invention is of the type comprising a structure formed by a supporting frame with metal crosspieces (10) and side walls (11H, 11K) which delimit a space in which are placed two rollers (R1, R2) oriented with their respective longitudinal axes orthogonally to the same walls (11H, 11K) and are positioned so as to define a nip (N) that can be crossed by the material (W) to be treated. Said rollers (R1, R2) are heatable rolls and are removably supported by said structure (10, 11H, 11K) in such a way that they can be removed and replaced with other heatable rolls when desired. The rollers (R1, R2) are designed to rotate with predetermined angular speed, in opposite directions, around their respective longitudinal axes. For this purpose, a drive unit (UM) is arranged to which the rollers (R1, R2) can be connected to control their rotation as previously mentioned. For simplification, the material (W) is represented only in FIG. 4, by means of a horizontal dotted line above which an arrow indicates the direction followed by the material itself.

The web-like material (W) is of the type normally used to make non-woven fabric products. For example, this material can consist exclusively of thermoplastic fibers or also of a mix of thermoplastic fibers and non-thermoplastic fibers such as cellulose, i.e. material intended to be processed by passing through a calender with heatable rollers.

Each roller (R1, R2) comprises an external surface (100) with reliefs (RR) arranged according to a predefined pattern. The rollers (R1, R2) are arranged in a so-called "tip-tip" configuration, meaning they are mutually arranged in such a way that the reliefs (RR) of one roller radially correspond to the reliefs (RR) of the other roller. Furthermore, each roller (R1, R2) has a pin at each of the heads (T1, T2), with a first pin (101) connectable to the drive unit (UM) and a second pin (102) through which it can be introduced a fluid for heating the roller. Said pins (101, 102) are aligned along the longitudinal axis of the roller which coincides with the rotation axis (r-r) of the latter when it is positioned in operating position on the aforementioned structure. A calender so structured is described in WO2020/183504.

The following description is provided to exemplify a possible embodiment of a calender which can be provided with a control mechanism in accordance with the present invention. Said control mechanism will be described later, in order to better illustrate its operation. It is understood that the structure of the calender, as well as the rollers and the members that connect the rollers to the structure of the calender, the means for moving the rolls and the heating methods of the rolls, can be configured in any other suitable way than described below.

For example, said drive unit (UM) comprises an electric motor (M) connected to two elastic axial joints (G1, G2) by means of a belt or chain transmission (not visible in the drawings) contained in a carter (CM) positioned externally to the structure (10, 11H, 11K). Each joint (G1, G2) is arranged in correspondence with the rotation axis (r-r) of a respective roller (R1, R2) and is equipped with a terminal end (200) sliding axially with respect to the joint itself. An arm (201) is connected to the terminal (200) with interposition of a bearing (202). On the opposite side, the arm (201) is connected to a hydraulic actuator (203) which, in turn, is integral with a side wall (11K) of said structure. The terminal end (200) is shaped to be coupled with a power take-off (103) arranged on the end of the first pin (101) of the respective roller (R1, R2). In accordance with the example shown in the attached drawings, the power take-off (103) is keyed onto the first pin (101) by means of shrink rings (104). Since the joints are two in number, that is equal to the number of rollers (R1, R2), two actuators (203) are provided, each acting on a respective arm (201) and each of the arms (201) is connected to the terminal end (200) of the corresponding joint (G1, G2). In FIG. 18A the joint (G1) is in engagement position on the first pin (101) while in FIG. 18B it is in disengagement position. The positioning of the joint in engagement/disengagement position on the first pin (101) is controlled by the actuator (203). As shown in FIG. 18B, in the disengagement position of the joint, a space (y) is formed between the terminal (200) and the power take-off (103) to allow the removal of the roller as further described below.

In accordance with the example shown in the attached drawings, the aforesaid structure comprises a pair of side walls (11H, 11K) for each side, i.e. a pair of side walls (11H, 11K) on the drive unit side (UM) and a pair of side walls (11H, 11K) on the opposite side, so as to have two outermost walls (11K) and two innermost walls (11H). The distance between the inner walls (11H) is smaller than the distance between the outer walls (11K). The internal side walls (11H) have, on the respective front sides (F), two overlapping recesses (300) suitable for partially housing corresponding bearings (105) presented by the rollers (R1, R2) in proximity to the respective heads (T1, T2). Furthermore, on the front side (F) of each internal side wall (11H) an actuator (301) is mounted, for example a hydraulic actuator, whose stem (302) is constrained to a front end of a lever (303). The latter has a concave part, with the concavity facing upwards, and is hinged to the respective internal side wall (11H) by means of a pin (340) with a horizontal axis arranged on the back of the lower recess (300), i.e. on the back of the recess (300) closest to the base (BA) of the structure. In practice, said pin (340) is on the opposite side with respect to the connection point (305) of the stem (302) at the front end of the lever (303). The concave part of the lever (303), which is intermediate between the said connection point (305) and the pin (340), cooperates with the respective lower recess (300) to delimit the lower housing of a corresponding bearing (105) of the lower roller (R2). The actuators (301) are synchronized, so that the two levers (303) rotate in synchronism around their respective pins (340).

On each external side wall (11K), and more precisely on the side facing the respective internal side wall (11H), a lever (304) is applied which preferably has a concave front side (350) with the concavity facing downwards, is constrained to the stem (306) of a corresponding hydraulic actuator (307), and is hinged to the wall (11K) by means of a pin with a horizontal axis (308) in an intermediate position between its concave front side (350) and the point (309) for connection to the actuator stem (307). The front side of each lever (304) is intended to engage from above a bearing (106) exhibited by each roller (R1, R2) at a predetermined distance from the previously mentioned bearing (105). Above the lever (304) there is another lever (310) which is identical to the first one (304) but is positioned specularly, that is, with the concavity of the respective anterior end (311) facing upwards instead of downwards. Said further lever (310) is also constrained to the stem (312) of a corresponding hydraulic actuator (313) and is hinged to the wall (11K) by means of a respective pin (314) with a horizontal axis at an intermediate position between its side front (311) and the connection point (315) to the actuator stem (313). The front side of the further lever (310) is intended to engage a corresponding bearing (106) from below.

On the front side (F) of each internal side wall (11H) a further lever (316) is mounted which on its rear side is connected to a corresponding hydraulic actuator (317), on its front side it has a concave part (318) which in operating position the calender faces the rear part (P) of the wall (11H), and is hinged to the wall (11H) by means of a respective pin (319) with a horizontal axis in an intermediate position between its front side (318) and the connection point (320) to the actuator (317) stem.

In practice, on each external side wall (11K) are applied:

- a lower lever (304) controlled by an actuator (307) which controls its rotation around a pin (308) with a horizontal axis by means of which the same lever is connected to the wall (11K), a free front end (350) of the said lower lever (304) being preferably concave with the concavity facing downwards; and
- an upper lever (310) controlled by an actuator (313) which controls its rotation around a horizontal axis pin (314) by means of which the same lever is connected to the wall (11K), a free front end (311) of said upper lever (310) being preferably concave with the concavity facing upwards.

Similarly, on each internal side wall (11H) are applied:

a lower lever (303) controlled by an actuator (301) which controls its rotation around a horizontal axis pin (340) by means of which the same lever is connected to the wall (11H), an intermediate part of said lower lever (303) being preferably concave with the concavity facing upwards; and an upper lever (316) controlled by an actuator (317) which controls its rotation around a pin (319) with a horizontal axis by means of which the same lever is connected to the wall (11H), a front part (318) of said upper lever (316) preferably being concave with the concavity facing the rear part (P) of the same wall (11H) when the calender is in operating position.

Therefore, the calender here described by way of example is provided, on each of its right and left sides, with two lower levers (303, 304) and two upper levers (316, 310) placed at a predetermined distance (d) from each other and adapted to come into contact with corresponding bearings (105, 106) arranged on the rollers (R1, R2) to exert on the same bearings (105, 106) forces (F1, F2, F3, F4) oriented according to non-coincident directions. In practice, for each right or left side of both rollers (R1, R2), said levers (303, 304, 310, 316) form two jaws acting along parallel planes spaced apart by a predetermined value (d).

With reference to the example shown in the attached drawings, the lower levers (303) and (308) exert an upward thrust (F1) on the bearings (105) adjacent to the heads (T1, T2) of the lower roller (R2) and, respectively, a downward thrust (F2) on the outermost bearings (106) of the same roller (R2). The upper levers (310) and (316) exert an upward thrust (F3) on the outer bearings (106) of the upper roller (R1) and, respectively, a thrust (F4) towards the rear side (P) of the caender on the bearings (105) adjacent to the heads (T1, T2) of the same upper roller (R1).

Consequently, the bending of the rollers (R1, R2) is reduced. In fact, said forces (F1, F2, F3, F4) act on parallel and non-coincident planes.

With reference to the example shown in the attached drawings, inside each roller (R1, R2) there is a conduit (HT) to feed a heating fluid, such as a diathermic oil of the type normally available on the market. For example, a diathermic oil of the type indicated in table 1 below can be used, where the letters A-E have the following meaning:

A: Manufacturer

B: Type

C: Viscosity at 40° C. (cSt or $mm^2/s$)

D: Viscosity at 100° C. (cSt or $mm^2/s$)

E: Density at 15° C. ($Kg/m^3$)

F: Auto-ignition temperature (° C.)

TABLE 1

| A | B | C | D | E | F |
|---|---|---|---|---|---|
| AGIP | ALARIA 3 | 30 | 5.3 | 870 | 320 |
| BP | TRANSCAL N | 30.4 | 5.28 | 870 | 350 |
| ESSO | ESSOTHERM 500 | 30 | 5.2 | 860 | 300 |
| CHEM GROUP | MARLOTHERM N | 20 | 3.4 | 877 | 330 |

For example, the selected diathermic oil is introduced into the duct (HT) at a temperature between 170° C. and 200° C. according to the specific treatment to be carried out on the material (W) introduced between the rollers (R1, R2) of the calender.

Said duct (HT) is arranged along the longitudinal axis of the roller (R1, R2) and has an inlet end (107) formed in the second pin (102) of the roller. Said inlet end (107) of the duct (HT) is provided with a valve (108) through which the heating fluid can be introduced into the duct (HT) and which also allows the inlet (107) to be blocked. The valve (108) is integral with the inlet (107) of the tube (HT), which is integral with the roller (R1, R2). In operation, the valve (108) is open to allow the heating fluid to circulate in the duct (HT), while it is closed when the roller (R1, R2) must be removed from the calender, as further described below. At a predetermined distance from each head (T1, T2) a septum (S1, S2) is arranged so that, inside the roller (R1, R2) and near each head (TR), a corresponding chamber (C1, C2) is formed, with a first chamber (C1) further away from the inlet (107) and a second chamber (C2) closer to this inlet. The duct (HT) ends in the first chamber (C1), that is, the outlet (109) of the duct (HT) is in the first chamber (C1). The latter has several holes (110) for communication with a thermal exchanger (111) coaxial and external to the duct (HT). The second chamber (C2) also has more holes (110) for communication with the thermal exchanger (111). In the second pin (102) a second duct (RF) is arranged to form a return line for the heating fluid. Said second duct (RF) is coaxial and external to the first duct (HT), and has an inlet section (112) formed in the second head (T2) and an outlet section (113) on which is mounted a corresponding valve (114) allowing the heating fluid to exit through the section (113) of the second duct (RF) and also allowing the same section to be blocked (113). The valve (113) is integral with the outlet (113) of the duct (RF), which is integral with the roller (R1, R2). In operating condition, the valve (113) is open to allow the heating fluid to pass through the second duct (RF), while it is closed when the roller (R1, R2) must be removed from the calender.

Therefore, the heating fluid introduced at a predetermined pressure into the duct (HT) through the inlet (107) fills the first chamber (C1), circulates in the thermal exchanger (111), enters the second chamber (C2) and exits through the second duct (RF). The inlet (107) of the delivery duct (HT) and the outlet (113) of the return duct (RF) are connected, through the respective valves (108, 114), to a fluid heating and supply system per se known, represented only in the diagram of FIG. 22 with the reference "HTS".

In accordance with the example shown in the attached drawings, the second pin (102) is crossed by both the delivery duct (HT) and the heating fluid return duct (RF) and the valves (108, 114) are both from the same side being both arranged on the free end of the second pin (102). In addition, the valves (108, 114) have respective outlets (180, 141) to insert the pipes (not visible in the drawings) for the supply and respectively for the evacuation of the heating fluid.

The jacket (100) of the roller (R1, R2) is coaxial and external to the thermal exchanger (111) from which it receives the heat conveyed by the heating fluid. For example, the thermal exchanger (111) inside the roller (R1, R2) consists of a helical coil whose external diameter corresponds to the internal diameter of the jacket (100) to ensure a correct heat exchange. For example, said coil is formed by a tube with a rectangular cross section wound in a helix. In accordance with the example described, the exchanger (111) extends along the entire length of the roller (R1, R2), between the two heads (T1, T2).

Preferably, a hydraulic joint is mounted on the end of the pin (102), formed by an internally hollow body (400) having a first internal axial duct (401) into which are positioned an end part of the duct (HT) and a second duct (402), coaxial and external to the first (401), which constitutes an extension of the heating fluid return conduit (RF). The conduit (401) ends with the valve (108), while the conduit (402) ends with the valve (114). The body (400) of the joint is integral with the roller (R1, R2) and, by means of a suitable appendix (403), is locked to the corresponding wall (11K) of the calender (1) when the roller is placed in the operating position. In this way, the valves (108, 114) are always in the same position during the rotation of the roller (R1, R2). In fact, the pin (102) rotates inside the joint (400) on which the valves (108, 114) are mounted.

Preferably, said valves (108, 114) are applied on the side of the joint (400) which, in the operating position of the roller (R1, R2), faces the rear side (P) of the calender (1). The valves (108, 114) are normally closed and are opened by respective actuators (508, 514) mounted at predetermined positions on a side wall (11K) of the calender (1). With particular reference to the example shown in FIG. 14B, on the wall (11K) there are two pairs of actuators (508, 514), i.e. a pair of actuators (508, 514) for each roller (R1, R2). The operation of this part of the calender (1) is described below with reference to the diagrams of FIGS. 19A and 19B which refer to a single valve (108) but it is understood that the operation is the same for all the valves, both those for the inlet (108) and those for the outlet (114) of the heating fluid: during the introduction of the heating fluid into the duct (HT), the piston (581) of the actuator (508) pushes on the front base (181) of the valve (108), the movement of which is transmitted to the lower element (182) of the internal group (182, 184) by means of the bridge (183) which connects the lower element (182) of the group with the upper one (184), so the heating fluid is free to pass through the valve as indicated by the arrows "T" in FIG. 19A; vice versa, when closing the valve (108), the piston of the actuator (508) is retracted as indicated in FIG. 19B, so that the lower body (182) of the aforementioned group (182, 184) is spaced from the upper body (184), and the fluid cannot pass through the lower element (182), on which the outlet (180) is engaged, and the escape of the fluid through the same out (180) is prevented.

As shown in particular in FIGS. 22 and 23, each pin (101, 102) can be provided with an internal channel designed to let air pass through it in order to reduce its temperature and thus preserve the integrity of the bearings (105, 106). Therefore, the control of the operating temperature of the bearings (105, 106) can be obtained without providing the external cooling circuits normally provided in hot roller calenders. With reference to the example shown in FIG. 22 and FIG. 23, in each pin (101, 102) a channel (CC) can be formed, developed parallel to the rotation axis (r-r) of the roller. Said channel (CC) forms a thermally insulating chamber in the pin which insulates the bearings with respect to the heat transmitted by the heating fluid. Eventually, air or even a thermally insulating material may be present in the channel (CC). As shown in the drawings, said channel (CC) develops under the bearings (105, 106).

Said channel (CC) can also be in communication with the outside by means of a first series of radial holes (RC) arranged near the relative head (T1, T2), where the diameter of the pin is greater, and a second series of holes (SC) at a predetermined distance (a) from the first series of holes (RC), where the diameter of the pin is smaller. The axes of the holes of the second series (SC) converge on the rotation axis (r-r) of the roller, presenting an inlet more distant from the head and an outlet closer to it. Said distance (a) is greater than the distance between the bearings (105, 106), so the air flowing in the channel (CC) can cool both bearings. As shown in FIG. 24, in the pin (102) on which the aforementioned valves (108, 114) are mounted, the channel (CC) is coaxial and external to the fluid return duct (RF).

The external air enters the channel (CC) through the holes (SC) and exits through the radial holes (RC) resulting in adequate thermal insulation of the bearings (105, 106) of the rollers (R1, R2). FIG. 18C shows a nozzle (UR) that blows air in the direction of the holes (SC) to further facilitate, if required, the circulation of air through the duct (CC).

The air-cooling ducting is arranged in both pins (101, 102) of the rollers (R1, R2) but this ducting could also be arranged in the pin (102) only. In FIG. 22 also the pin (101) is provided with the aforementioned cooling ducting.

Two bushings (B) can be applied to each pin (101, 102) of the rollers (R1, R2), each of which bushings is preferably placed at an intermediate position between two corresponding bearings (105, 106) and is suitable for being engaged by the arms of an overhead crane (not shown in the drawings) whose function is to move the rollers (R1, R2) between the calender (1) and one or more parking or waiting stations for the rollers.

For example, to allow the removal of a roller (R1, R2) from the calender (1), the levers (303, 304, 310, 316) are made to rotate around their respective pins, each by the corresponding actuator (301, 307, 313, 317), in order to free the bearings (105, 106) and release the roller from the seats (300). In this phase, the connection of the roller to the drive unit is disengaged, freeing the respective power take-off (103), and the supply of the heating fluid is interrupted by closing the valves (108, 114) by means of the actuators (508, 514). The procedure for disengaging the roller involved in the removal by the bridge crane, as well as the procedure for closing the valves (108, 114) and the procedure for releasing the bearings (105, 106), is managed automatically by an actuators control unit (UE) which controls the actuators previously described. A block diagram relating to the control of the actuators by the actuator control unit (UE) is in FIG. 23.

As previously said, the foregoing description has been provided in order to exemplify a possible configuration of a calender which can be equipped with a control mechanism in accordance with the present invention, it being understood that this mechanism is generally applicable to calender differently structured for what concerns the supporting structure, the rollers and the members which connect the rollers to the calender structure, the means for moving the rollers and the methods for heating the rollers themselves. Therefore, a control mechanism in accordance with the present invention can be equally applied to calenders, in particular for the heat treatment of web materials passing in a nip formed by two hot engraved rollers mutually arranged in a tip-to-tip configuration, in which the structure bearing can have only two rollers support walls, in which the heating system of the rollers is not configured as previously described but is configured according to different criteria, in which the rollers are constrained to the bearing structure by means of restraint members other than the levers (304, 310, 303, 316) previously described, and in which the rollers are driven into rotation around their respective longitudinal axes by means of motor members other than the drive unit (UM) previously described. For example, as shown in FIGS. 20A-20C, the drive unit (UM) includes two electric motors (M), one for each roller of the calender.

Advantageously, in accordance with the present invention, in order to ensure the maintenance of the axial phase of the rollers (R1, R2), a control of the uniform heating of the rollers is carried out. A possible method of practical implementation of this control involves the detection of the axial elongation of the rollers (R1, R2) due to their heating. In general terms, an unacceptable axial phase loss is associated with a different axial elongation of the two rollers which exceeds a predetermined limit value (for example 3/10 mm) in accordance with the present invention. For example, said detection can be performed using a linear encoder (E1, E2) placed on one side of each of the rollers (R1, R2) to measure the axial elongation due to their heating. As schematically shown in FIG. 22, each of said encoders (E1, E2) is connected to a programmable control unit (UCP) which receives the electrical signals produced by the same encoders and compares them with each other. If the axial elongation of one roller differs from the axial elongation of the other roller by a value that exceeds a predetermined threshold, the control unit (UCP) generates an alarm signal. Said alarm signal can activate an acoustic and/or light signaling device (SAL) and/or a procedure for automatic restoration of the conditions of regular operation of the calender.

The acoustic and/or light signal can serve to alert the operators responsible for running the calender who, in this way, will be able to intervene to restore the normal operating conditions of the calender, that is, to bring the difference in axial elongation of the rollers (R1, R2) below the preset threshold by manually adjusting the amount of hot fluid introduced into the rollers.

The procedure for automatically restoring the normal operating conditions of the calender involves an automatic adjustment of the amount of hot fluid introduced into the rollers. In this case, for example, the control unit (UCP) is connected to the valves (108) located on the inlets (107) for introducing the hot fluid into the rollers (R1, R2), the valves (108) being solenoid valves that can be controlled by the control unit (UCP). Through the controlled closing and opening of the solenoid valves (108), the control unit (UCP) can adjust the operating temperature of each of the rollers (R1, R2) in such a way as to bring the difference in axial elongation of the rollers themselves to a value lower than the pre-established threshold. The positive or negative sign of the difference in axial length thus detected can be used to to identify the hottest roll. For example, if the difference D=dL1−dL2 between the elongations (dL1, dL2) of the rollers (R1, R2) is positive, the control system interprets this condition as indicative of a greater axial elongation of the roller (R1) with respect to the roller (R2). Conversely, if the difference D=dL1−dL2 between the elongation (dL1, dL2) of the rollers (R1, R2) is negative, the control system interprets this condition as indicative of a greater axial elongation of the roller (R2) with respect to the roller (R1). Consequently, the control unit (UCP) reduces the flow rate of the heating fluid introduced into the hottest roller if said axial elongation difference exceeds the predetermined threshold value. FIG. 24 represents an operating condition in which, by way of example, the upper roller (R1) undergoes a greater elongation than the lower roller (R2), so that the difference D=dL1−dL2 is positive. In the enlarged details of the same figure, it can be seen that the greater axial elongation of the roller (R1) has determined a loss of correspondence between the reliefs (RR) of the two rollers, in particular at one side of the calender (right side in the drawing). Alternatively, the control unit (UCP) modifies the set point of the heating unit of the hottest roller if the said axial elongation difference exceeds the preset threshold value. In this case, the control unit (UCP) does not intervene on the valves (108) but commands a reduction in the set point of the heating unit that feeds the fluid to the hottest roller. In FIG. 22 the connection between the control unit (UCP) and the heating units (HTS) is represented by the dashed arrows "UH". Also in this case what has been said in relation to the sign of the difference between the axial elongation of the rollers (R1, R2) applies.

In both the cases exemplified above, the system for heating the rollers (R1, R2) comprises several individually controllable heating units (HTS), each of which feeds a hot fluid to a respective calender roll.

In practice, the axial elongation of the rollers (R1, R2) is controlled by an active control of the operating temperature of the rollers themselves, this active control being carried out by means of detectors (for example, said encoders E1, E2) which are configured to detect the axial elongation of the rollers and are connected to the control unit (UCP) which is configured to adjust the operating temperature of the rollers according to the detections performed by the detectors in order to maintain a possible difference in axial elongation of the rolls below a predetermined threshold.

With reference to the example of construction illustrated in FIGS. 18A-18C, each encoder (E1, E2) is a magnetic encoder mounted on an arm (201) of the engagement/disengagement mechanism of the motion transmission to the rollers (R1, R2). In this example, each encoder (E1, E2) comprises a magnetic slider (MS) fixed to a plate (PM) which, in turn, is fixed on a side of the respective arm (201). Therefore, each translation of the arm (201) parallel to the axis (r-r) of the respective roller (R1, R2) involves an equal translation of the magnetic slider (MS) on the respective encoder which, therefore, produces a position signal correlated to the position of the arm (201). The arrow "SA" in FIG. 18C (enlarged detail of FIG. 18A) indicates a thrust exerted on the arm (201) by the elongation of the roller (R1) which corresponds to a translation of the slider (MS) of the encoder (E1) visible in the drawing.

The axial elongation of any one of the calender rollers (elongation along the direction of the r-r axis) implies a thrust, exerted by this roller on the respective bearing (202), which determines a translation of the corresponding arm (201) parallel to the axis (r-r) of the roller and, consequently, a translation of the magnetic slider (MS) which is transduced by the encoder into a position signal transmitted to the control unit (UCP) programmed to intervene as previously described. Since the actuators (203) are pneumatic or hydraulic actuators operating at relatively low pressure, the actuators (203) do not hinder the elongation of the rollers and consequently do not hinder the translation of the arms (201) and therefore the translation of the magnetic sliders (MS).

According to the example shown in FIG. 21, on a bracket (210) by which the actuator (203) is connected to the wall (11K) of the calender there is an appendage (211) on which an inductive sensor is mounted (IS). The latter detects the distance of the arm (201) from the appendix (211). Therefore, similarly to the case previously exemplified, each translation of the arm (201) parallel to the axis (r-r) of the relative roller (R1, R2) involves an equal translation of the arm (201) is detected by the inductive sensor (IS). The arrow "SA" in FIG. 21 also indicates a thrust exerted on the arm (201) by the elongation of the roller (R1). In this example, an inductive sensor (IS) is provided for each of the calender rolls. Furthermore, also in this case the sensor (IS) constitutes a transducer that produces a position signal of the arm (201) used by the control unit (UCP) as previously described.

In practice, in accordance with the present invention, it is envisaged to detect the axial elongation of each roller of the calender, axial elongation due to the heating of the same rolls, by means of sensors configured for this purpose and arranged in the calender, and, by means of a programmable control unit, comparing the elongations of the rollers and generating an alarm signal if the difference between these elongations exceeds a predetermined limit value.

The actuators control unit (EU) can be physically integrated with the control unit (UCP).

According to the foregoing description, a calender according to the present invention is a calender for the treatment of web materials (W), comprising a fixed structure (10, 11H, 11K, 300) adapted to support two mutually heated rollers (R1, R2) arranged so as to form a nip (N) that can be crossed by web materials (W), wherein each roller (R1, R2) has surface reliefs (RR) arranged according to a predetermined pattern, in which the rollers (R1, R2) are mutually arranged in a tip-to-tip configuration, in such a way that in an operating position of the calender, the reliefs (RR) of one roller (R1) are radially opposed to the reliefs (RR) of the other roller (R2) in correspondence with said nip (N), wherein each of said rollers (R1, R2) is connected to a drive unit (UM) which determines its rotation with a predetermined angular speed around its own longitudinal axis (r-r), wherein said rollers (R1, R2) are heated by means of heating elements configured to individually heat each roll (R1, R2) of the calender, and wherein each roll (R1, R2) undergoes an axial elongation as a consequence of its heating, and comprises detection means (E1, E2; IS) adapted to detect the axial elongation of each roller (R1, R2) and a programmable control unit (UCP) connected to said detection means and to said heating means, said programmable control unit being programmed to determine the difference between the axial elongations of the rollers (R1, R2) detected by said detection means and emitting an alarm signal if the absolute value of this difference is greater than a predetermined limit value. In accordance with particular methods of implementation of the invention, a calender in accordance with the present invention may have one or more of the following characteristics:

- said detection means consist of magnetic encoders (E1, E2).
- said encoders (E1, E2) are linear encoders.
- said detection means are constituted by inductive sensors (IS).
- said detection means are arranged and acting at one end of said rollers (R1, R2).
- said alarm signal controls the activation of an acoustic and/or light signal.
- said alarm signal controls said roll heating means (R1, R2) by reducing the temperature of the roller that undergoes the greatest elongation, said control unit (UCP) determining the positive or negative sign of the difference.
- the rollers (R1, R2) are driven in rotation around their respective longitudinal axes by means of a drive unit (UM) comprising one or two electric motors (M).
- said rollers (R1, R2) are provided with internal conduits (HT, RF) in which a fluid fed by said heating means can circulate.

A method for the treatment of web-like materials by means of a calender for the treatment of web materials (W), comprising a fixed structure (10, 11H, 11K, 300) adapted to support two mutually heated rollers (R1, R2) arranged so as to form a nip (N) that can be crossed by web materials (W), wherein each roller (R1, R2) has surface reliefs (RR) arranged according to a predetermined pattern, in which the rollers (R1, R2) are mutually arranged in a tip-to-tip configuration, in such a way that in an operating position of the calender, the reliefs (RR) of one roller (R1) are radially opposed to the reliefs (RR) of the other roller (R2) in correspondence with n nip (N), wherein each of said rollers (R1, R2) is connected to a drive unit (UM) which determines its rotation with a predetermined angular speed around its own longitudinal axis (r-r), wherein said rollers (R1, R2) are heated by means of heating elements configured to individually heat each roll (R1, R2) of the calender, and wherein each roll (R1, R2) undergoes an axial elongation as a consequence of its heating, in accordance with the present invention involves detecting the axial elongation of each roller (R1, R2) with means for detecting axial elongation (E1, E2; S) of the rollers (R1, R2) and determining the difference between the axial elongations of the rollers (R1, R2) detected by the said detection means (E1, E2; S) and emitting an alarm signal if the absolute value of this difference is greater than a predetermined limit value.

In accordance with particular methods of implementing a method in accordance with the invention,

- the detection of the axial elongation of the rollers (R1, R2) is performed by detection means consisting of magnetic encoders (E1, E2) or inductive sensors (IS).
- if magnetic encoders are used, these encoders (E1, E2) are preferably linear encoders.
- said detection means are preferably arranged and acting at one end of said rollers (R1, R2).
- said alarm signal controls the activation of an acoustic and/or light signal.
- said alarm signal is emitted by a control unit (UCP) which controls said roller heating means (R1, R2) by reducing the temperature of the roller which undergoes the greatest elongation, said control unit (UCP) evaluating the sign, positive or negative, of said difference as a function of the detections carried out by said detection means.

In practice, the details of execution may in any case vary in an equivalent manner as regards the individual elements described and illustrated and their reciprocal arrangement, without thereby departing from the idea of the solution adopted and therefore remaining within the limits of the protection conferred by this patent in conformity of the following claims.

The invention claimed is:

1. Calender for the treatment of web materials (W), comprising a fixed structure (10, 11H, 11K, 300) adapted to support two heated rollers (R1, R2) mutually arranged so as to form a nip (N) that can be crossed by web-like materials (W), wherein each roller (R1, R2) has surface reliefs (RR) arranged according to a predetermined pattern, wherein the rollers (R1, R2) are mutually arranged in a tip-to-tip configuration, such that in an operational setting of the calender the reliefs (RR) of one roller (R1) are radially opposed to the reliefs (RR) of the other roller (R2) in correspondence with said nip (N), wherein each of said rollers (R1, R2) is connected to a drive unit (UM) which determines its rotation with a predetermined angular speed around its own longitudinal axis (r-r), wherein said rollers (R1, R2) are heated by heating means configured to heat individually each roller (R1, R2) of calender, and wherein each roller (R1, R2) undergoes an axial elongation as a consequence of its heating, characterized in that it comprises detection means (E1, E2; IS) adapted to detect the axial elongation of each roller (R1, R2) and a programmable control unit (UCP) connected to said detection means and to said heating means, said programmable control unit being programmed to determine the difference between the axial elongations of the rollers (R1, R2) detected by said detection means and emitting an alarm signal if the absolute value of this difference is greater than a predetermined limit value.

2. Calender according to claim 1 characterized in that said detection means are magnetic encoders (E1, E2).

3. Calender according to claim 1 characterized in that said encoders (E1, E2) are linear encoders.

4. Calender according to claim 1 characterized in that said detection means are inductive sensors (IS).

5. Calender according to claim 1, characterized in that said detection means are arranged and acting at one end of said rollers (R1, R2).

6. Calender according to claim 1 characterized in that said alarm signal controls the activation of an acoustic and/or light signal.

7. Calender according to claim 1 characterized in that said alarm signal controls said roller heating means (R1, R2) by reducing the temperature of the roll which undergoes the greatest elongation, said control unit (UCP) determining the positive or negative sign of said difference.

8. Calender according to claim 1 characterized in that the rollers (R1, R2) are rotated around their respective longitudinal axes by means of a drive unit (UM) comprising one or two electric motors (M).

9. Calender according to claim 1 characterized in that both said rollers (R1, R2) are provided with internal ducts (HT, RF) in which a fluid fed by said heating means can circulate.

10. Method for the treatment of web materials (W) with a calender comprising a fixed structure (10, 11H, 11K, 300) adapted to support two heated rollers (R1, R2) mutually arranged so as to form a nip (N) that can be crossed by web-like materials (W), wherein each roller (R1, R2) has surface reliefs (RR) arranged according to a predetermined pattern, wherein the rollers (R1, R2) are mutually arranged in a tip-to-tip configuration, such that in an operational setting of the calender the reliefs (RR) of one roller (R1) are radially opposed to the reliefs (RR) of the other roller (R2) in correspondence with said nip (N), wherein each of said rollers (R1, R2) is connected to a drive unit (UM) which determines its rotation with a predetermined angular speed around its own longitudinal axis (r-r), wherein said rollers (R1, R2) are heated by heating means configured to heat individually each roller (R1, R2) of calender, and wherein each roller (R1, R2) undergoes an axial elongation as a consequence of its heating, characterized in that it comprises the detection of the axial elongation of each roller (R1, R2) by means of detection means (E1, E2; IS) adapted to detect the axial elongation of each roller (R1, R2) and comprises the determination of the difference between the axial elongations of the rollers (R1, R2) detected by said detection means and the production of an alarm signal if the absolute value of this difference is greater than a predetermined limit value.

11. Method according to claim 10 characterized in that the detection of the axial elongation of the rollers (R1, R2) is performed by detection means consisting of magnetic encoders (E1, E2) or inductive sensors (IS).

12. Method according to claim 10 characterized in that said detection means are arranged and acting at one end of said rollers (R1, R2).

13. Method according to claim 10 characterized in that said alarm signal controls the activation of an acoustic and/or light signal.

14. Method according to claim 10 characterized in that said alarm signal is emitted by a control unit (UCP) which controls said means for heating the rollers (R1, R2) by reducing the temperature of the roller undergoing a greater elongation, said control unit (UCP) determining the positive or negative sign of said difference as a function of the detections performed by said detection means.

* * * * *